US007670022B2

(12) United States Patent
Kessler et al.

(10) Patent No.: US 7,670,022 B2
(45) Date of Patent: Mar. 2, 2010

(54) LIGHTED FLOOR MAT SYSTEM

(75) Inventors: Ronald N. Kessler, Girard, OH (US); Daniel A Kessler, Girard, OH (US); David M. Neill, Boardman, OH (US)

(73) Assignee: R&L Marketing & Sales, Inc., Youngstown, OH (US)

( * ) Notice: Subject to any disclaimer, the term of this patent is extended or adjusted under 35 U.S.C. 154(b) by 61 days.

(21) Appl. No.: 11/523,891

(22) Filed: Sep. 20, 2006

(65) Prior Publication Data

US 2007/0258255 A1 Nov. 8, 2007

Related U.S. Application Data

(60) Provisional application No. 60/798,228, filed on May 5, 2006.

(51) Int. Cl.
*F21S 8/00* (2006.01)

(52) U.S. Cl. ..... 362/153; 362/488; 362/253; 362/806; 362/559

(58) Field of Classification Search ..... 362/82, 362/802, 153, 488, 487
See application file for complete search history.

(56) References Cited

U.S. PATENT DOCUMENTS 4,544,993 A 10/1985 Kirk
5,019,950 A * 5/1991 Johnson ..... 362/130
5,848,830 A * 12/1998 Castle et al. ..... 362/84
6,417,778 B2 * 7/2002 Blum et al. ..... 340/815.4
6,481,877 B1 11/2002 Bello, Jr.
6,604,834 B2 * 8/2003 Kalana ..... 362/84
6,736,442 B2 * 5/2004 Gebreselassie et al. ... 296/97.23
6,844,058 B2 * 1/2005 Blum et al. ..... 428/343

* cited by examiner

*Primary Examiner*—Sandra L O'Shea
*Assistant Examiner*—Jessica L McMillan
(74) *Attorney, Agent, or Firm*—Sand & Sebolt

(57) ABSTRACT

A floor mat system that includes a mat having a decoratively shaped first portion that allows light to transmit therethrough and is surrounded by a second portion that does not allow light to transmit therethrough. A light source is positioned beneath at least the first portion of the mat. When activated, the light source shines through the first portion and thereby illuminates and draws attention to the decorative image. The light source is coated in a polycarbonate resin film to protect and strengthen the same against damage as people walk over the mat. A non-transparent coating may be applied to selective regions of the protective film to create the same decorative transparent image therein and to thereby allow light to only be emitted from a particular region of the light source. The mat may be made from a flow-through material, a non-flow-through material with a gripping upper surface and wells; or a combination of flow-through and non-flow-through material. The mat also includes a transformer housing and channels to protect a transformer and electrical wiring from being damaged as people walk over the mat.

34 Claims, 20 Drawing Sheets

LIGHTED FLOOR MAT SYSTEM

CROSS-REFERENCE TO RELATED APPLICATIONS

This is a standard utility application which claims priority from U.S. Provisional Application Ser. No. 60/798,228, filed May 5, 2006, the entire specification of which is incorporated herein by reference.

BACKGROUND OF THE INVENTION

1. Technical Field

This invention generally relates to floor mats. Specifically, the invention relates to a floor mat having a substantially transparent or translucent portion in its upper surface which allows light to pass therethrough and therefore makes a decorative image visible and which further includes a light source disposed beneath the decorative image. The light source illuminates the decorative image drawing attention to the same.

2. Background Information

Recessed floor mat systems or stand-alone mats are frequently positioned in the entrances of malls, stores and businesses to ensure that particulate matter and water are removed from peoples' shoes as they enter the premises. The mats are fairly typically manufactured from vinyl or a variety of fibrous materials that scrape and wipe the matter off the shoes. Such mats may be of a flow-through type, where particulate matter and water droplets drop through apertures in the surface and are directed to a collection area of some type. This substantially prevents the matter and droplets from accumulating on the upper surface of the mat and then being tracked into the premises by others at a later time. Alternatively, the mats may by solid mats that include wells which retain the collected particulate matter and water.

In either event, these entryway mats form part of the initial impression that a consumer or client may have of a business. There is therefore an opportunity in the art for the provision of a mat that enhances the initial impression of a business instead of fading into the general background of the company and leaving no lasting impression of the same.

SUMMARY OF THE INVENTION

The device of the present invention comprises a floor mat system that includes a mat which has a first decorative portion that is transparent or translucent and therefore allows light to pass therethrough, and in which the first portion is surrounded by a second portion that is non-transparent or non-translucent portion and therefore substantially prevents light from passing therethrough. A light source is positioned beneath the first portion and, when activated, the light source shines through the first portion and illuminates and draws attention to the decorative image. The light source is coated in a polycarbonate resin film to protect and strengthen the same against damage as people walk over the mat. A non-transparent coating may additionally be applied to selective regions of the protective film to effectively create the same decorative transparent image in the film as in the mat. Light emitted from the light source is then only directed through the transparent region causing the same to be more effectively illuminated. The mat may be made from a flow-through material, a non-flow-through material with a gripping upper surface and wells; or a combination of flow-through and non-flow-through material. The mat system also includes a transformer housing and channels to protect a transformer and electrical wiring from being damaged as people walk over the mat. The mat system may also include a ramped base into which the mat is inserted, in which case the mat and base may be used as a stand-alone mat. Alternatively, the mat system may be used in conjunction with a spacer and be placed in a recessed area in a flat surface such as a concrete floor, so that the upper surface of the mat is flush with the floor.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 14:
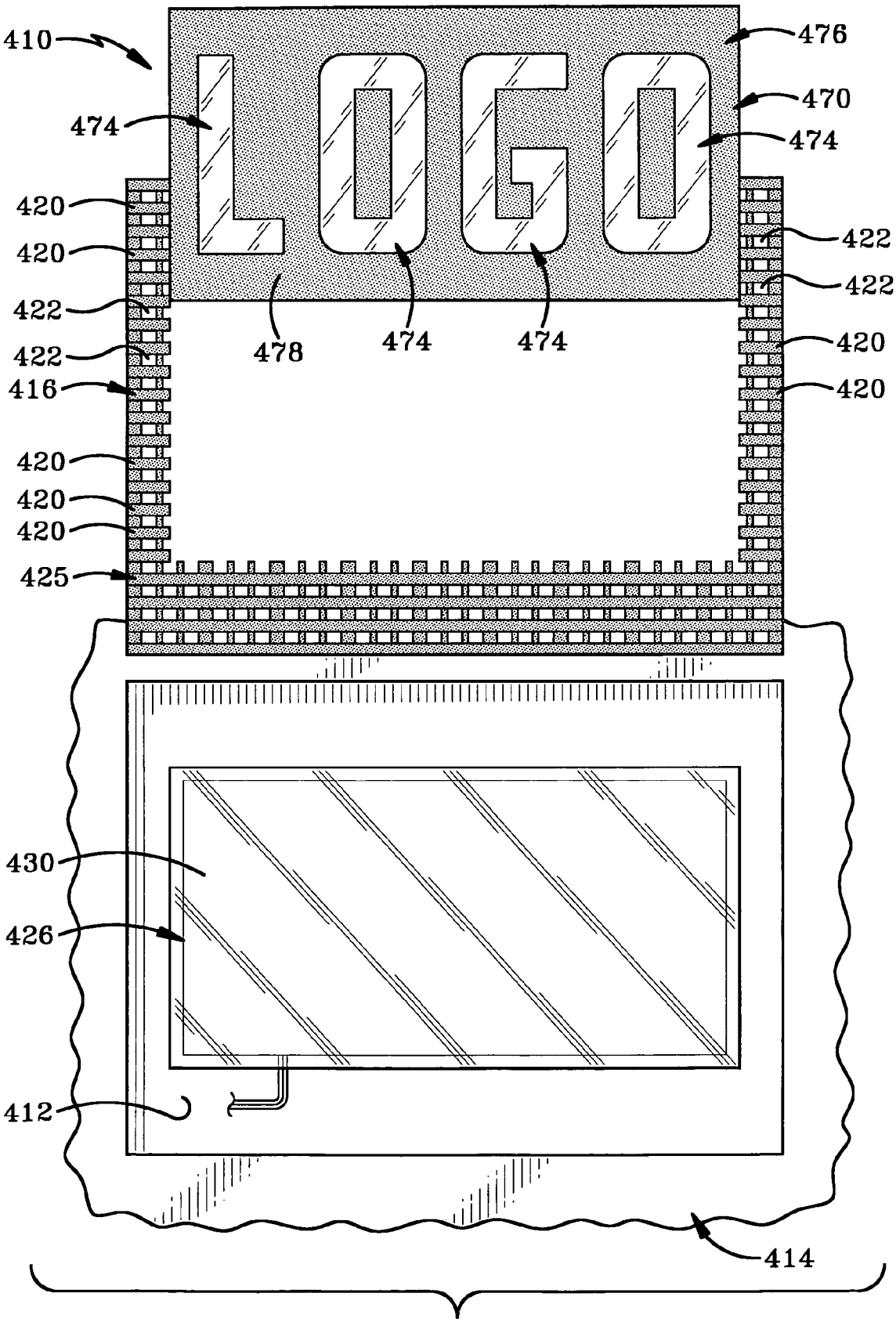
FIG. 14 is a partially exploded top view of the floor mat system of FIG. 13.

Referring to FIG. 14 there is shown a first embodiment of a lighted floor mat in accordance with the present invention and generally indicated at 10. Mat 10, as illustrated, is of a type that is inserted into a spacer 12 in a concrete surface 14. Mat 10 preferably is manufactured from vinyl and has an upper surface 16 and a lower surface 18. Mat 10 therefore is constructed to have solid areas 20 that are interspersed with apertures 22. Apertures 22 may take the form of depressions of lower elevation that are formed in upper surface 16 relative to the higher elevation solid areas 20 and which therefore form wells in the mat which capture liquid and particulate matter that is scraped from the shoes of people walking over the mat. In this instance, apertures 22 will terminate above lower surface 18. Alternatively, apertures 22 may be openings that extend from upper surface 16 through lower surface 18 and which allow the liquid and particulate matter to drop through mat 10 and onto the surface beneath that mat, i.e., the mat is a flow-through type mat. The exact configuration and positioning of solid areas 20 and apertures 22 do not form part of the present invention. Apertures 22 allow particulate matter, water and/or snow that are deposited on upper surface 16 to be removed therefrom either by dropping into wells formed by the depression-like apertures or by falling through hole-like apertures onto the surface on which mat 10 is resting. In the embodiment illustrated in FIG. 1, the apertures 22 are of the hole-like type and particulate and liquid matter are removed from upper surface 16 by falling through mat 10 and coming to rest on the concrete positioned in the area defined by spacer 12.

In accordance with one of the specific features of the present invention, mat 10 preferably is manufactured from a vinyl that is clear, transparent or translucent. Consequently, any features positioned beneath mat 10 could be at least partially visible through areas of mat 10. Solid areas may be configured to include areas of slightly higher elevation and slightly lower elevation so that as a person walks across mat 10, the differences in elevation aid in removing matter from their shoes.

In accordance with another of the specific features of this invention, a first portion of mat 10, indicated by the number 24, remains substantially transparent or translucent, while a second portion 25 of mat 10 is covered or treated so that it becomes non-transparent or non-translucent. The following description will refer to the first portion 24 of mat 10 as transparent, but it will be understood that the description would apply equally to a mat that has a translucent first portion. The second portion 25 of mat 10 is treated so that it becomes non-transparent or non-translucent. This treatment preferably involves coating the second portion 25 of the mat with a suitable paint, so that objects beneath mat 10 are no longer visible. Suitable paints for this application include those such as CHEMGLAZE®, manufactured by Lord Corporation of Erie, Pa.; and DUPLI-COLOR® manufactured by the Dupli-Color Products Company of Cleveland, Ohio, and marketed by Sherwin Williams.

In accordance with yet another feature of the present invention, the first portion 24 of mat 10 preferably is used as an advertising medium in that it is shaped to form a decorative design, slogan or word. So, for example, in FIG. 1, the first portion 24 is shaped to form the word "LOGO". This is accomplished by placing a logo template on upper surface 16 of mat 10 and applying the suitable paint over the entire upper surface 16 and template. The paint coats all areas of upper surface 16, other than those disposed beneath the template. This leaves the areas 24 under the template in an un-coated and therefore a substantially clear or transparent state. The remaining areas, i.e., the second portion 25, become coated with paint and are therefore non-transparent. Thus, the design on the template is transferred onto mat 10. The paints used in this operation have been found to be most effective when the paint selected is dark in color, such as black, so that the contrast between the first and second portions 24, 25, is quite distinct and the design or logo tends to stand out and catch peoples' eyes as they approach or walk over mat 10.

It will be understood, however that mat 10 may be formed from two different materials without departing from the spirit of the present invention. The two materials could be a first material that is non-transparent and forms the second portion 25; and a second material that is transparent and forms the first portion 24. The first portion 24 is shaped into the desired logo, slogan or word, without departing from the spirit of the present invention.

Figure 1:
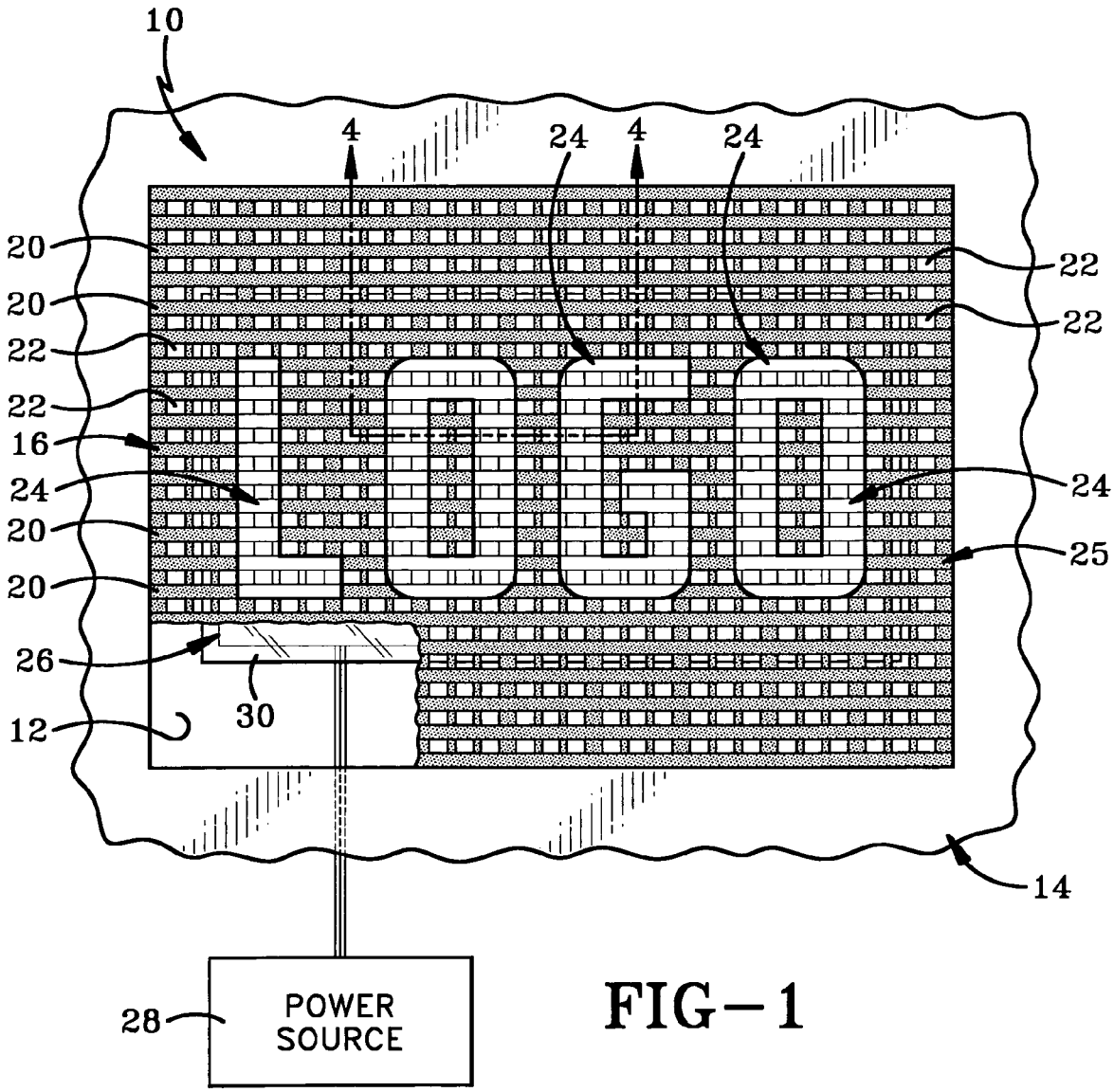
FIG. 1 is a partial cutaway top view of a lighted floor mat system in accordance with the present invention.
Figure 2:
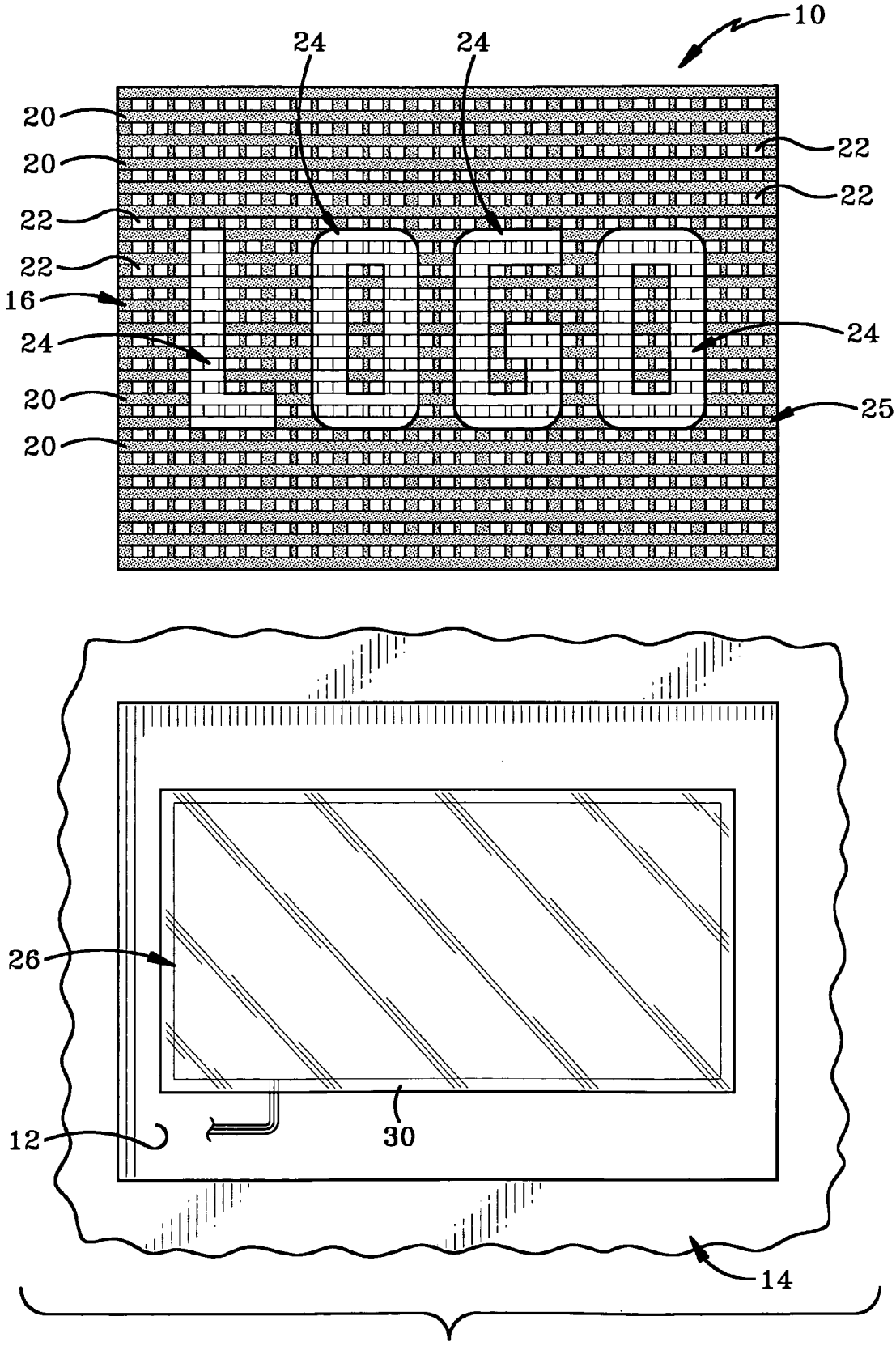
FIG. 2 is a partially exploded top view of the floor mat system of FIG. 1.

In accordance with yet another of the specific features of the present invention, a generally rectangular light source 26 is provided to illuminate at least the transparent portion 24 of mat 10. Preferably, light source 26 is a substantially flat and planar pad that is positioned beneath lower surface 18 of mat 10 and, more specifically, beneath that region of mat 10 that incorporates the transparent first portion 24. Suitable light sources 26 for this application include the CEELITE™, manufactured by CeeMee, Inc. of Lansdale, Pa., and the electroluminescent FLATLITE®, manufactured by E-Lite Technologies, Inc. of Trumbull, Conn. The light source 26 is connected to a suitable power source 28 (FIG. 1). Light rays 36 emanating from light source 26 shine through the transparent first portions 24 and the apertures 22. When the light rays 36 shine through the transparent portion 24, the shape of the logo, word or slogan designed therein becomes illuminated and highlighted. The logo, slogan or word therefore becomes more noticeable, easier to see and therefore more useful as an advertising tool for the business establishment.

Figure 3:
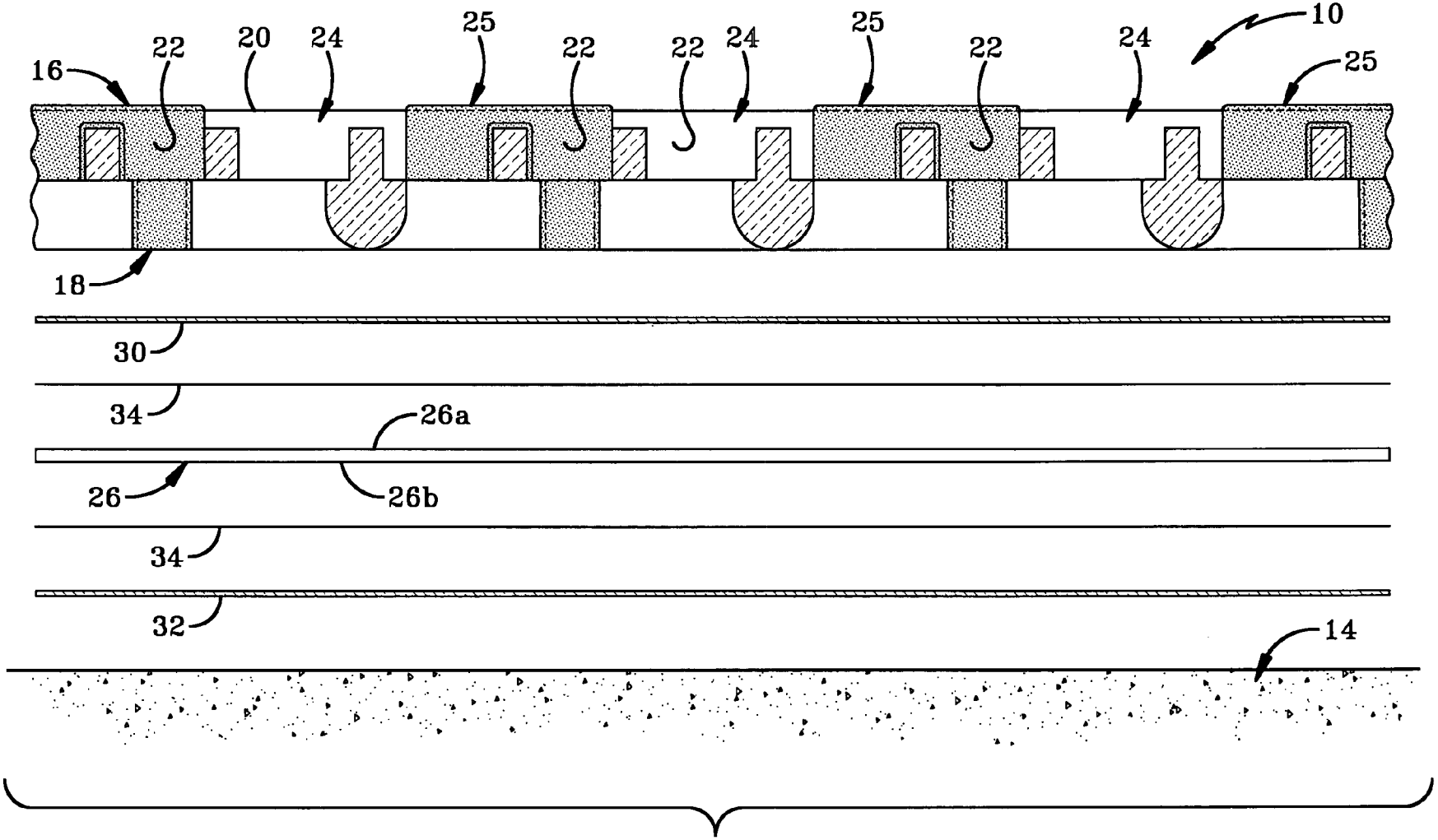
FIG. 3 is an exploded cross-sectional side view the floor mat of FIG. 1.

Inasmuch as mat 10 is a flow-through mat, particulate matter and water are able to drop through apertures 22 and onto the surface 14 below mat 10. Furthermore, mat 10 is contemplated for use in very high traffic areas and therefore needs to withstand fairly high compressive forces, dirt, water and abuse. It has been found that over a fairly short time, particulate matter and water can result in substantial damage to the light source 26 and tends to lead to its premature failure. In order to address this issue, a protective layer 30 (FIG. 3) is applied to at least the top surface 26*a* of light source 26. Protective layer 30 is disposed between lower surface 18 of mat 10 and the light source 26. A second protective layer 32 is preferably applied to the underside 26*b* of light source 26. An adhesive 34 is applied to secure the protective layers 30, 32 to light source 26 and to each other around the side edges of light source 26. The light source 26 is therefore essentially trapped in an envelope formed by protective layers 30, 32. This prevents particulate matter and water from coming into direct contact with light source 26 and therefore prolongs the life of the same. Suitable protective layers 30, 32 have been found to be polycarbonate resin layers such as those sold under the trademark LEXAN®, made by General Electric Company of Pittsfield, Mass. Protective layers 30, 32 provide additional strength to mat 10 as well as preventing water and particulate matter from being crushed into light source 26 as people walk over mat 10.

Protective layers 30, 32 have been found to substantially increase the life of light source 26. Tests were conducted to determine the effect of protective layers 30, 32. In a first test, a Powerlinks® vinyl mat, manufactured by Boardman Molded Products, Inc. of Youngstown, Ohio, the Assignee of the present invention, was placed on top of a light source before testing began. The testing system comprised the surface (14), a light source, a Powerlinks mat, a testing wheel and a 40 lb. weight. The weighted wheel was passed back and forth across the mat. After the cycle testing process reached 275,000 passes, dirt was added to observe the effect it had on the light source and on the mat. Shortly after adding the dirt to the experiment, at 420,000 passes, the light began to show wear and some minor tearing of the mat itself. At 420,000 passes, water was added to the dirt. At 560,000 passes, the light had totally failed and would not illuminate.

In a second test, a 0.020 inch thick film of clear LEXAN was applied to both the top and bottom surfaces of the light source, so that the light source was effectively trapped between the LEXAN layers. Again, a wheel weighted with 40 lbs. was cycled back and forth across the mat. Initially, no dirt was applied to mat 10. At 2,000,000 passes, small areas of the light source had been damaged, but the light source did not fail. Dirt was added at this point. At 2,500,000 passes, minor cracks were observed in the LEXAN and small amounts of dirt began to creep inside those cracks. The light source still functioned properly and there was no dimming of the light. At 3,000,000 passes, the seamed edges in the LEXAN surrounding the edges of the light source between to give and break. The failure of the seamed edges was attributed to the very small seam used in the test mat (the seam being roughly 0.250 inches wide). The wheel cycling on the mat was stopped at 3,908,994 passes. Large amounts of dirt had found their way into the broken seam around the edges of the light source, but the light still functioned properly. The LEXAN was found to substantially increase the life of the light source.

Figure 4:
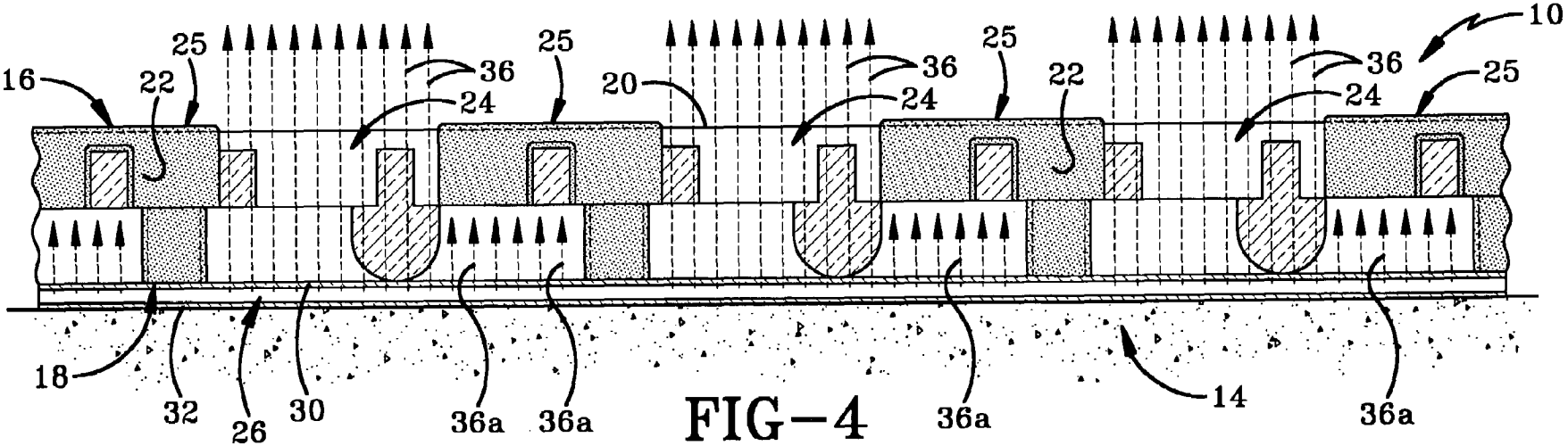
FIG. 4 is a cross-sectional view of the floor mat system through line 4-4 of FIG. 1.
Figure 8:
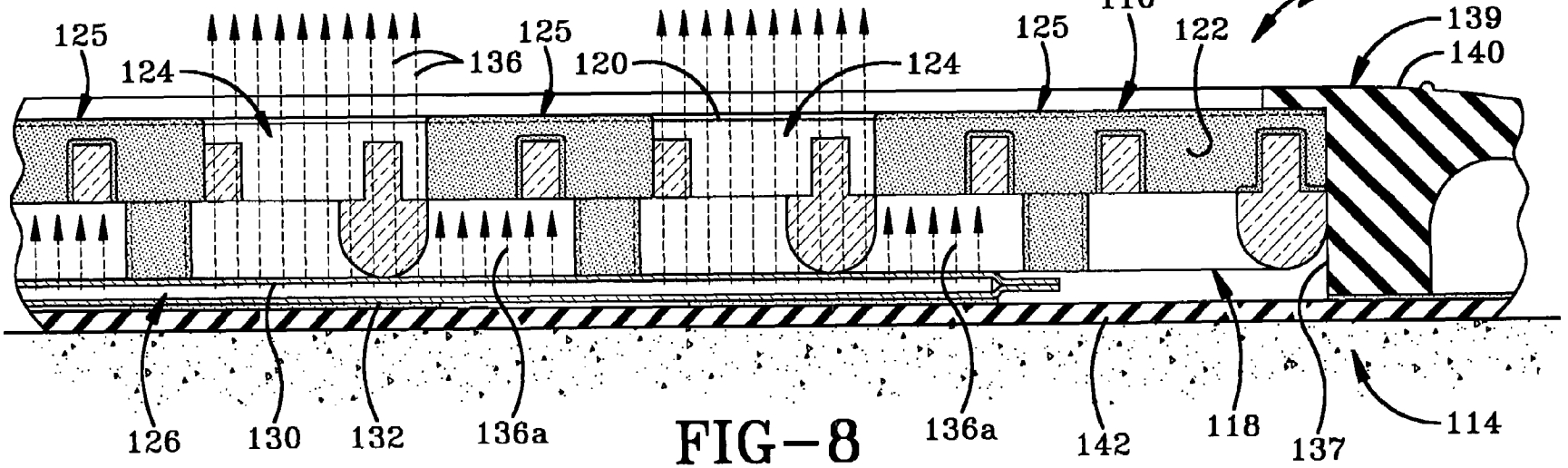
FIG. 8 is cross-sectional view of the floor mat system through line 8-8 of FIG. 5.
Figure 5:
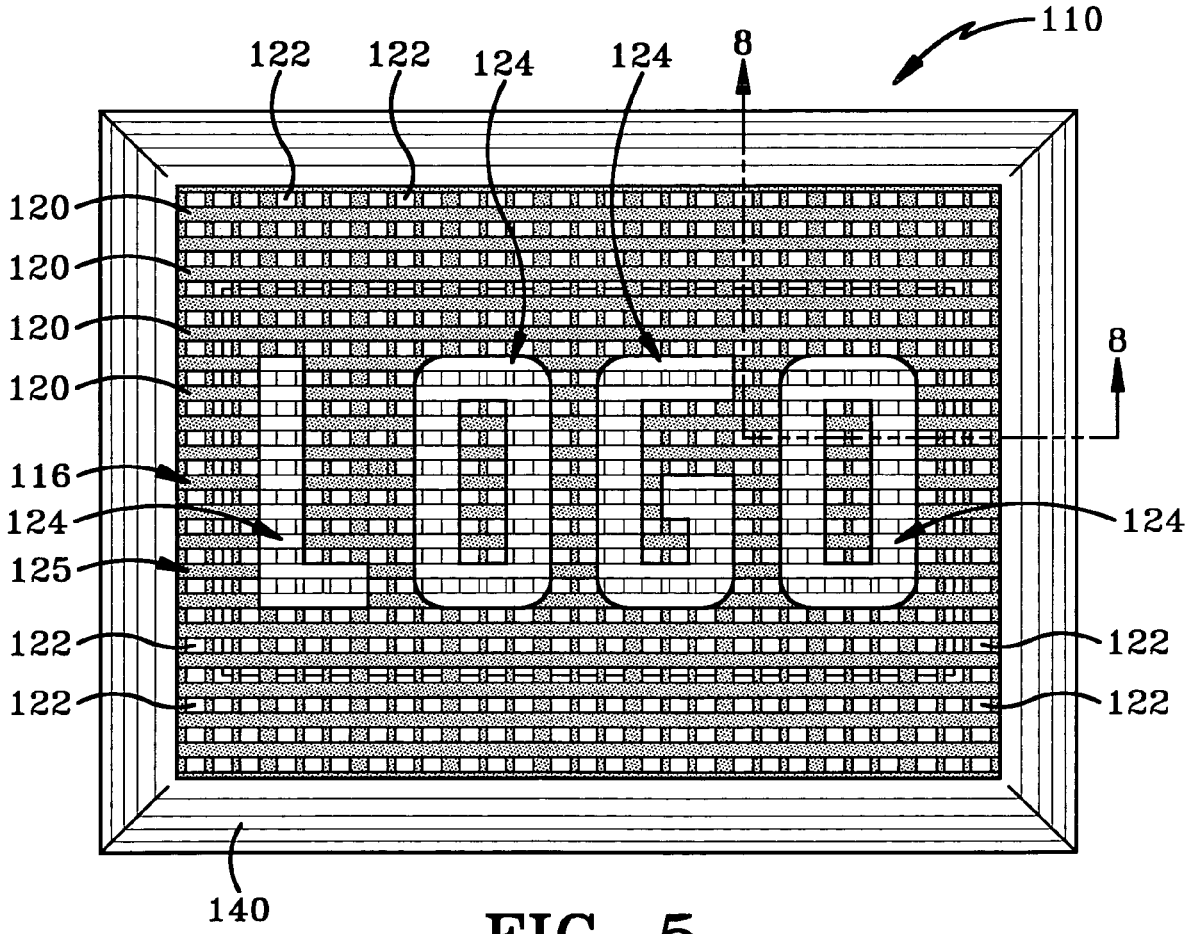
FIG. 5 is a top view of a second embodiment of the floor mat system in accordance with the present invention.
Figure 6:
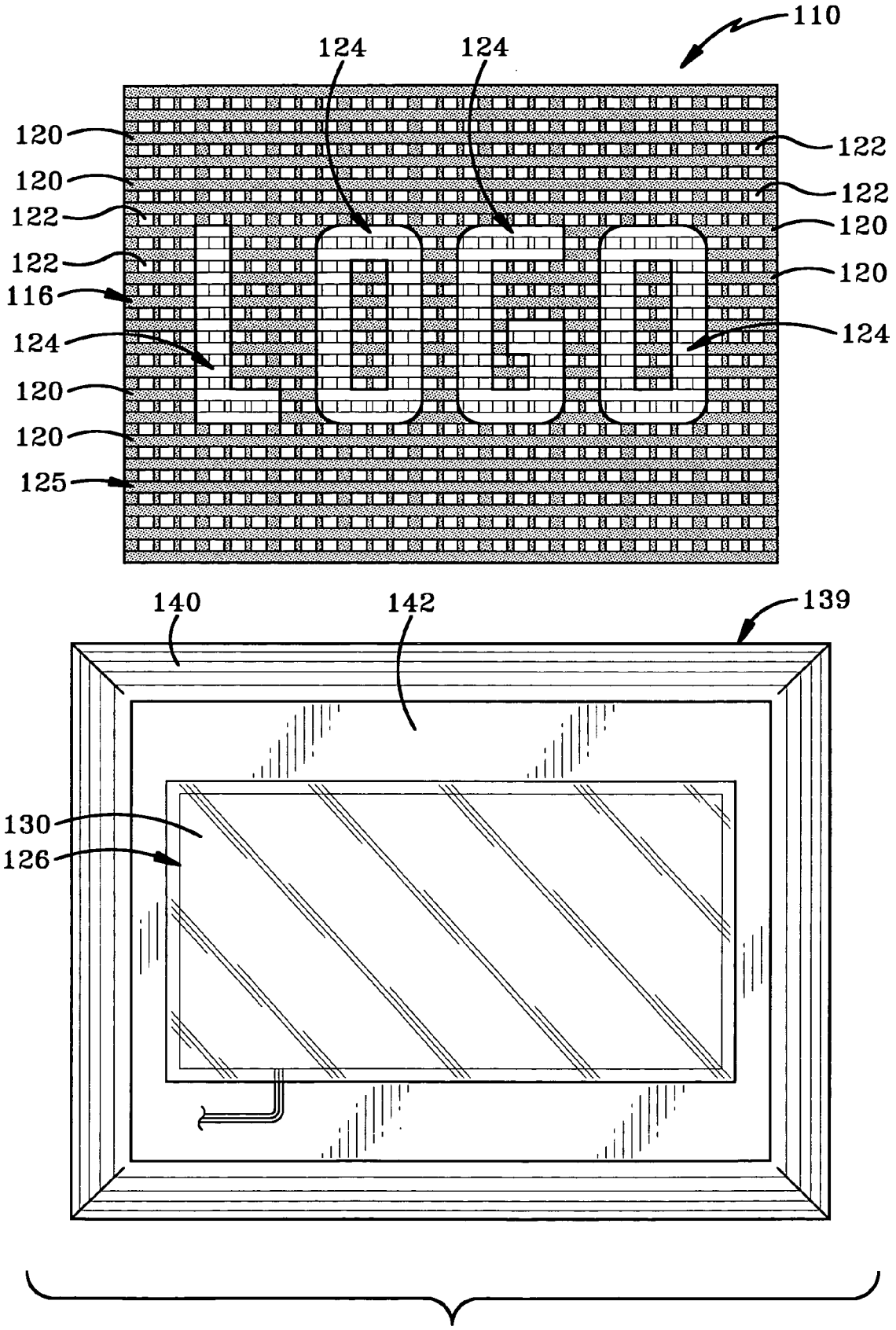
FIG. 6 is a partially exploded top view of the floor mat system of FIG. 5.
Figure 7:
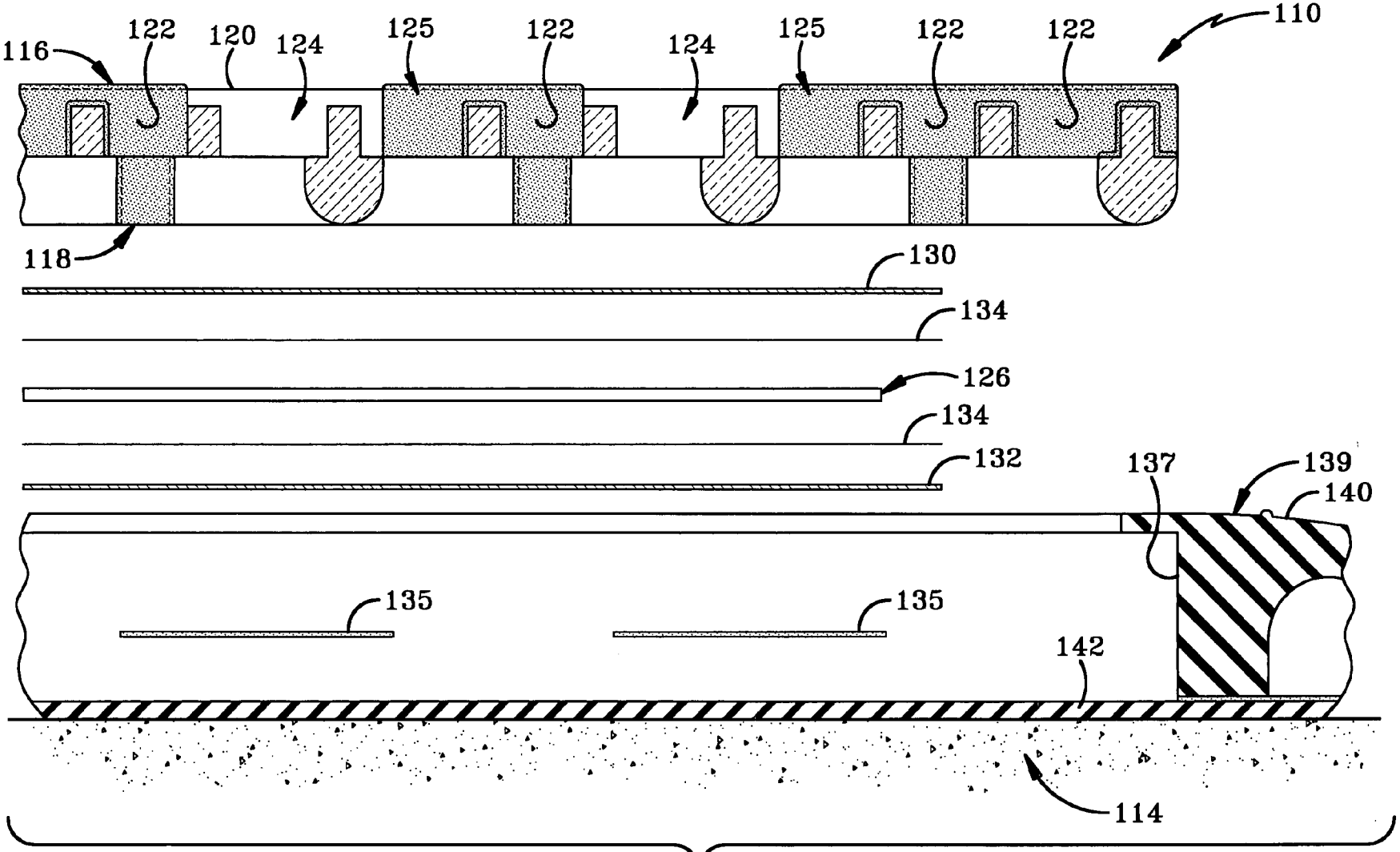
FIG. 7 is an exploded cross-sectional side view of the floor mat of FIG. 5.

FIG. 4 shows the light source 26 activated and emitting light rays 36 and those rays 36 shining through transparent sections 24 of upper surface 16. Other light rays 36*a* are prevented from shining out of mat 10 by non-transparent portion 25 of mat 10. Not only do the light rays 36 shine out from transparent sections 24, but they also shine out of apertures 22 in mat 10.

A second embodiment of a floor mat system in accordance with the present invention is shown in FIGS. 5-8 and is generally indicated at 110. Mat 110 is designed to be a stand-alone flow-through mat that is positioned on top of the floor surface 114. As such, mat 110 is inserted into a base 139 (FIG. 6) comprising a peripheral ramped wall 140 and a substantially continuous recessed floor 142, that receives mat 110 therein. Base 139 surrounds and underlays mat 110. Mat 110 is manufactured from the same material and in substantially the identical manner to mat 10 but is then inserted into the base. Base 139 preferably are manufactured from rubber and are deep enough to retain any particulate matter and water that flow through mat 110. Light source 126 is secured to the lower surface 118 of mat 110 and the lowermost LEXAN layer may be secured to floor 142 of the base by way of additional adhesive strips or layers 135. It should be understood that instead of adhesive strips 135, the protective film may be secured to the floor of the base by way of strips of hook and loop fasteners (not shown) such as those manufactured by Velcro Industries of the Netherlands and sold under the trademark VELCRO; or strips of self-mating reclosable fasteners such as those manufactured by Minnesota Mining and Manufacturing Company (3M) and sold under the trademark DUAL LOCK; mat retainers currently used in the industry or any other suitable connectors. Furthermore, mat 110 can be secured to the interior walls 137 (FIG. 7) of ramped area 140 of base 139 instead of to the floor 142 thereof. Alternatively, the base 139 may be a vinyl self-contained backing system within vinyl ramps surrounding the backing. The light source would then be secured to the vinyl backing and the mat 110 laid over the light source and enclosed by the ramps.

Light rays 136 emanating from light source 126 shine outwardly through the transparent portions 124 and apertures 122 in mat 110. The non-transparent second portion 125 of mat 110 substantially prevents light rays 136*a* from shining therethrough. Consequently, the transparent portions 124 of the mat 110 are illuminated and are highlighted. As with the previous embodiment, the transparent portions 124 are preferably designed to spell a word, slogan or logo.

Figure 9:
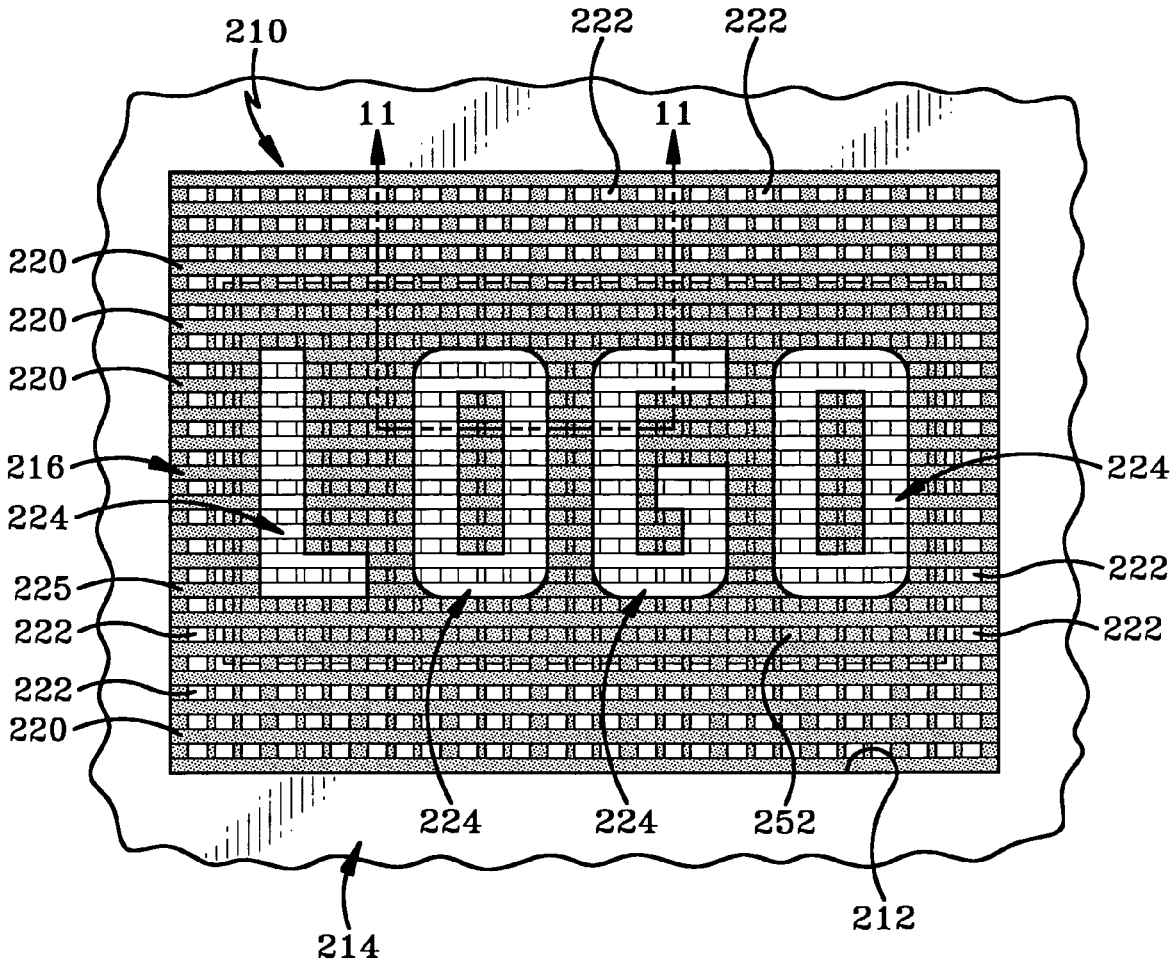
FIG. 9 is a partial top view of a third embodiment of the floor mat system in accordance with the present invention.
Figure 10:
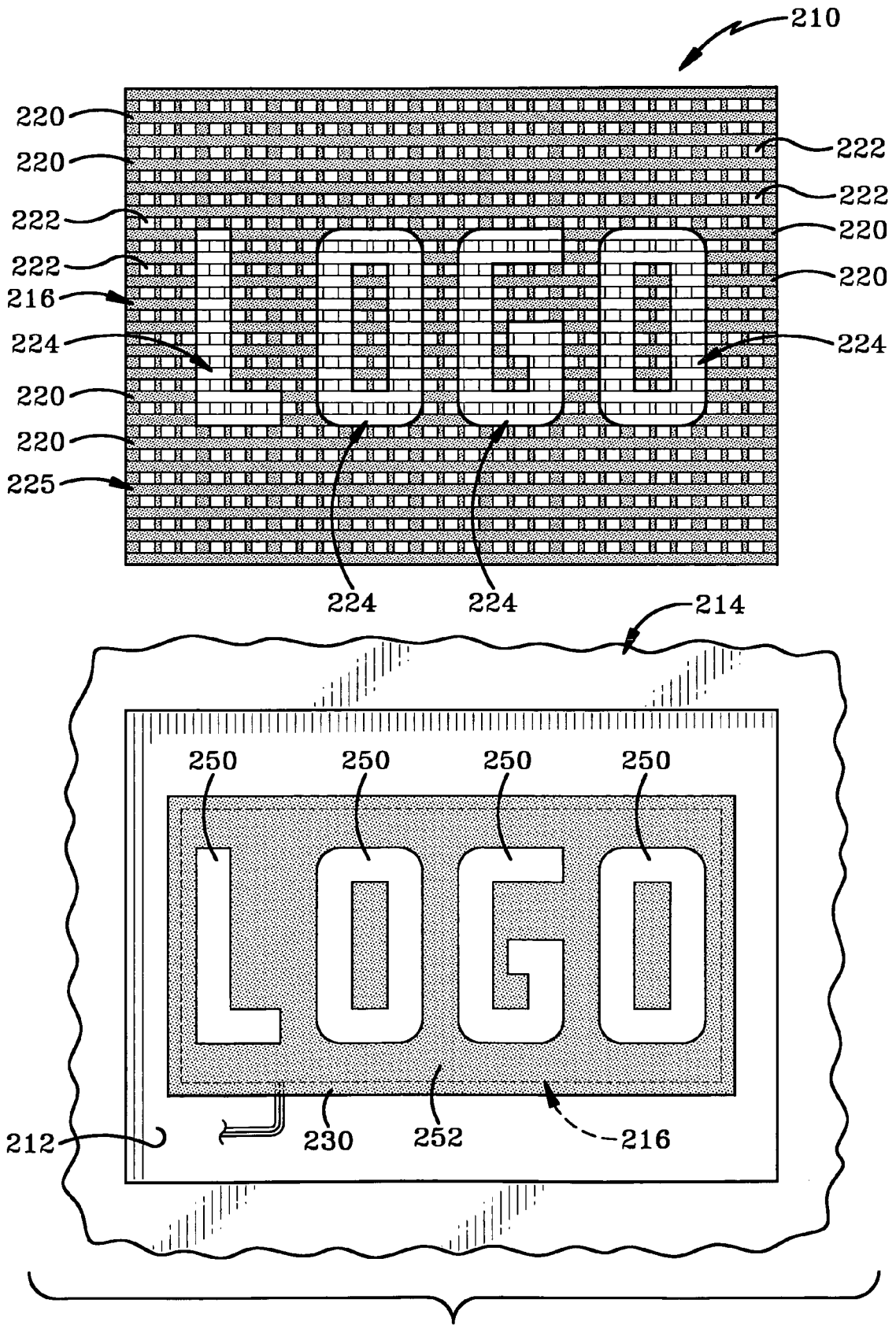
FIG. 10 is a partially exploded top view of the floor mat system of FIG. 9.
Figure 11:
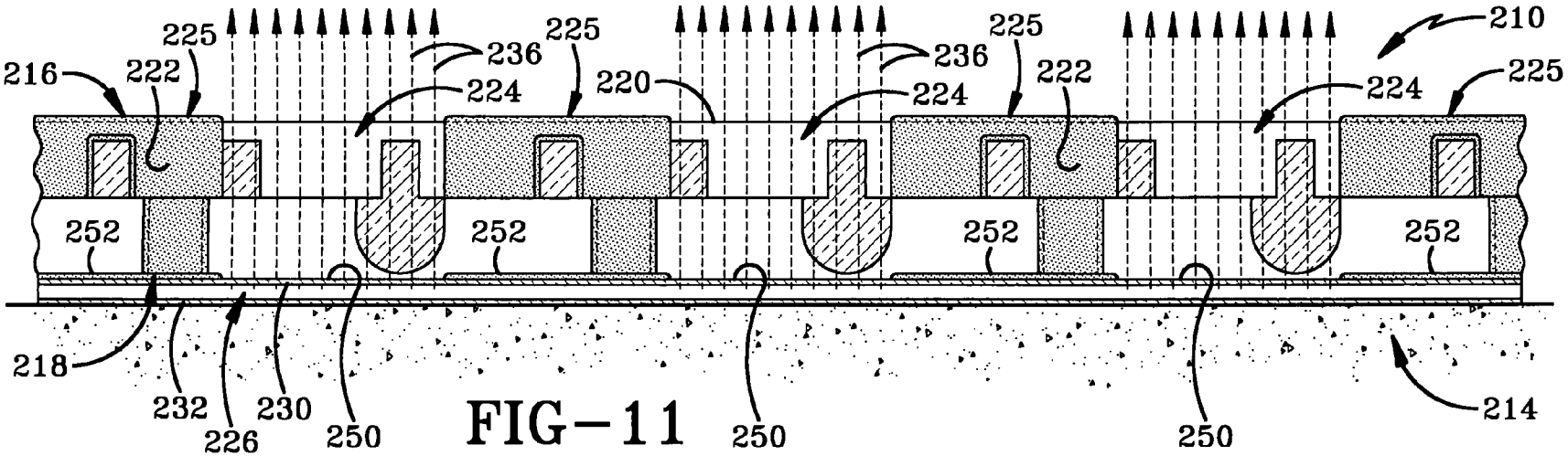
FIG. 11 is a cross-sectional view of the floor mat system through line 11 of FIG. 9.

FIGS. 9-11 show a third embodiment of a floor mat system in accordance with the present invention and generally indicated at 210. All components of this mat 210 are substantially the same as the previous embodiments, with the exception that a portion of the upper protective layer 230 is coated with a suitable substance, such as paint, to make it non-transparent. Thus, in FIGS. 9&10, a paint layer 252 is disposed over certain parts of protective layer 230. Paint layer 252 is applied by placing the logo template over upper protective layer 230 and spraying paint thereover. Those portions of protective layer 230 disposed beneath the template and therefor not covered by paint layer 252, remain transparent. The transparent portion 250 of protective layer 230 is shaped, designed, sized and positioned to align with the transparent portion 224 of mat 210. The rest of protective layer 230 becomes coated in a layer of paint and therefore becomes non-transparent.

When light rays 236 from light source 226 shine through protective layer 230, the non-transparent paint layer 252 substantially prevents any light rays 236 from traveling therethrough. Thus, when mat 210 is viewed from above, a substantially darkened region surrounds the transparent portion 224 of mat 210. This causes the design of the transparent portion 224 to be more effectively highlighted as no light rays 236 can be transmitted through apertures 222 which are disposed immediately above the paint coated portions of protective layer 230.

Figure 12:
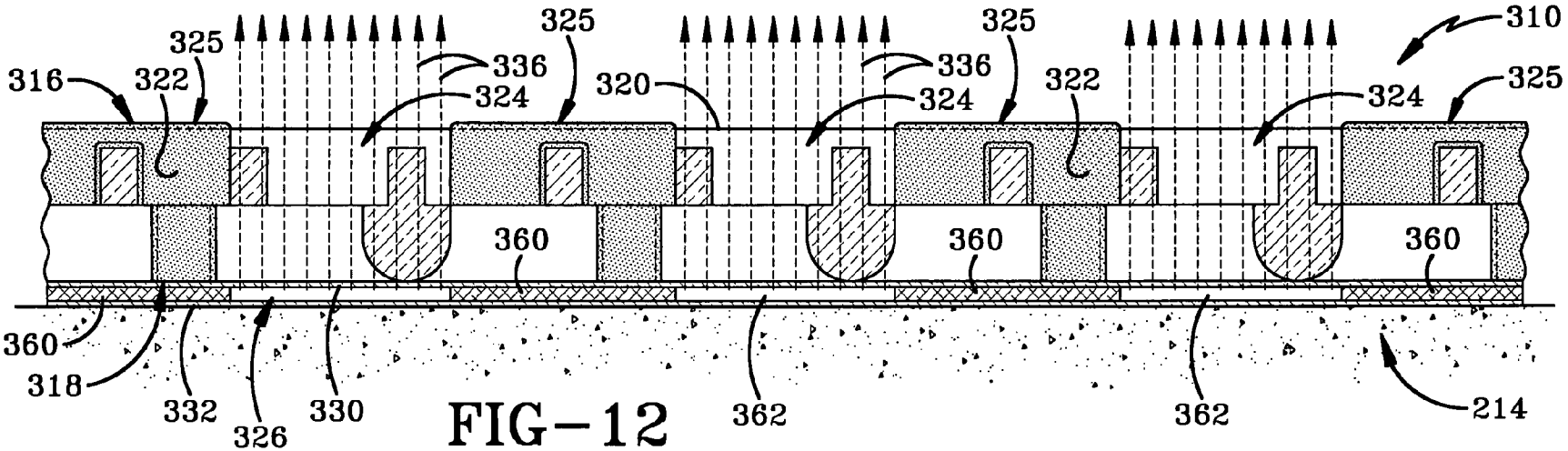
FIG. 12 is a cross-sectional view of a fourth embodiment of the floor mat system in accordance with the present invention.

A fourth embodiment of a floor mat system in accordance with the present invention is shown in FIG. 12 and generally indicated at 310. In mat 310, the light source 326 has been selectively damaged in regions 360, by crimping or patterned stamping, for example. This causes the non-damaged portion of the light source 326 to be shaped in a like manner to the design or logo. Consequently, the light rays 336 are only emitted from non-damaged portions 362 of light source 326. Those rays 336 travel through transparent portions 324 of mat 310 and therefor illuminate the design formed thereby.

Figure 13:
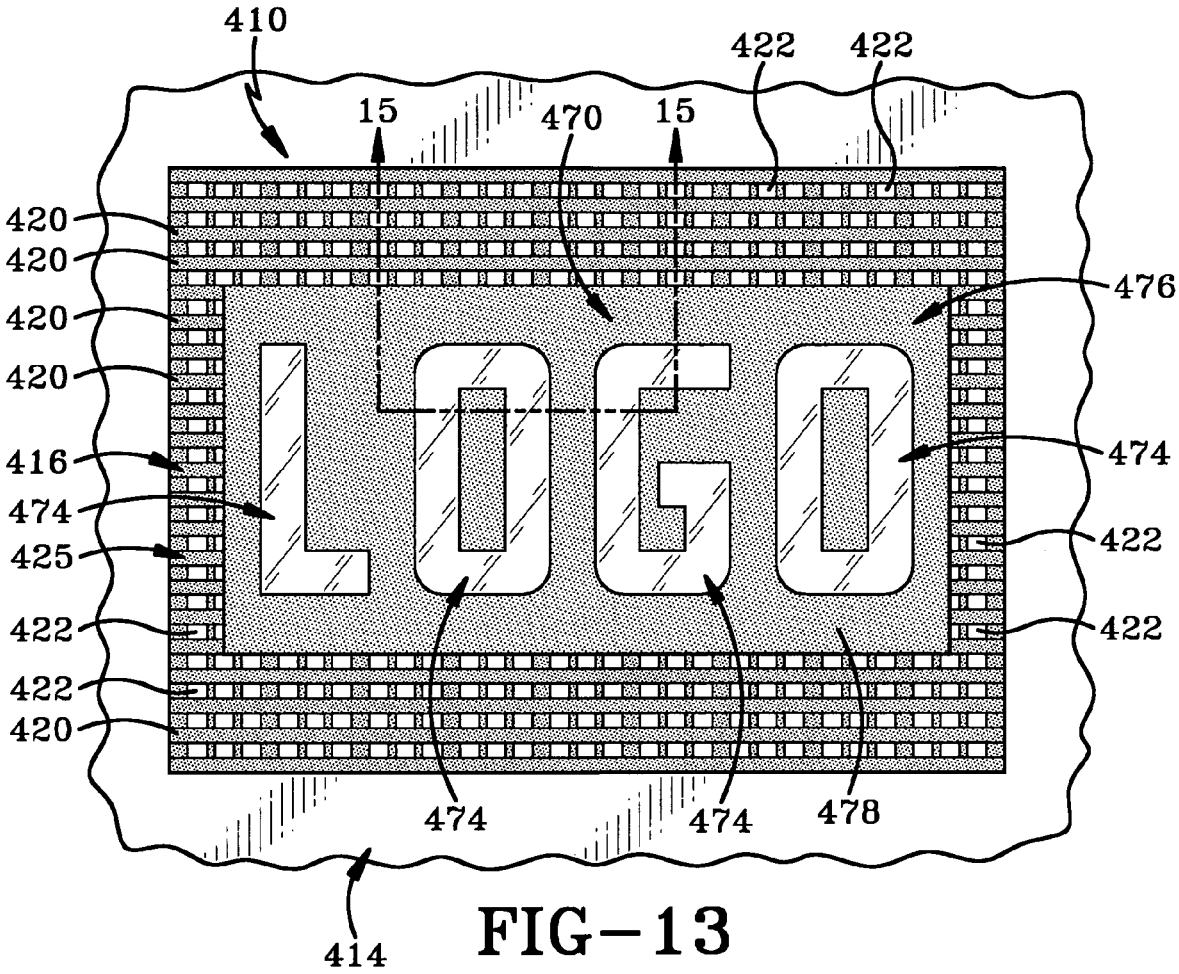
FIG. 13 is a partial top view of a fifth embodiment of the floor mat system in accordance with the present invention.
Figure 15:
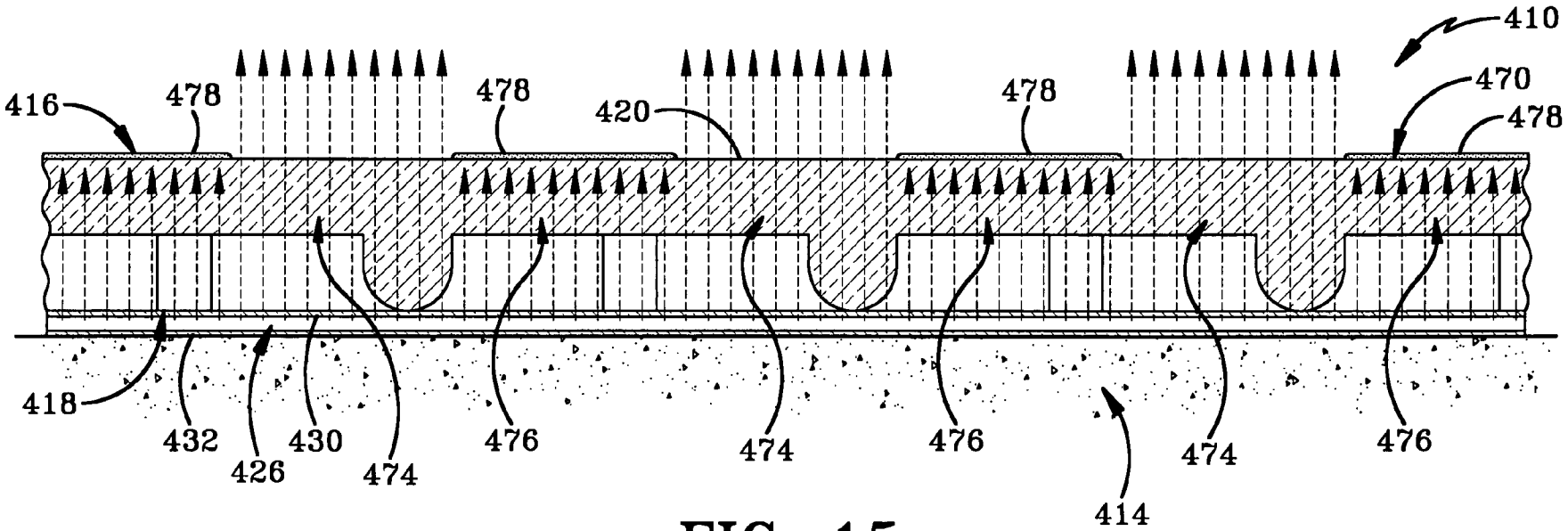
FIG. 15 is a cross-sectional view of the floor mat system through line 15-15 of FIG. 13.

FIGS. 13-15 show a fifth embodiment of a floor mat system in accordance with the present invention and generally indicated at 410. Mat 410 has a first region manufactured from a flow-through type material and a second region 470 manufactured from a non-flow-through type of material. FIG. 14 shows that second region 470 constitutes an insert in mat 410. Insert 470 has the desired logo formed thereon in a similar manner to previous embodiments, namely the positioning of a logo template and application of a suitable paint thereover. Insert 470 has transparent regions 474, shaped into the desired design or logo, and non-transparent regions 476. Non-transparent regions 476 include the paint coating 478. When mat 410 is assembled, insert 470 is positioned, as with previous embodiments, over a protective layer 430, a light source 426 and second protective layer 43. The various layers may be secured together by adhesive (not shown). Insert 470 preferably is made of a material that provides a non-slip or gripping surface so that as people walk over the mat 410 with wet shoes, they will not slip or fall.

Figure 16:
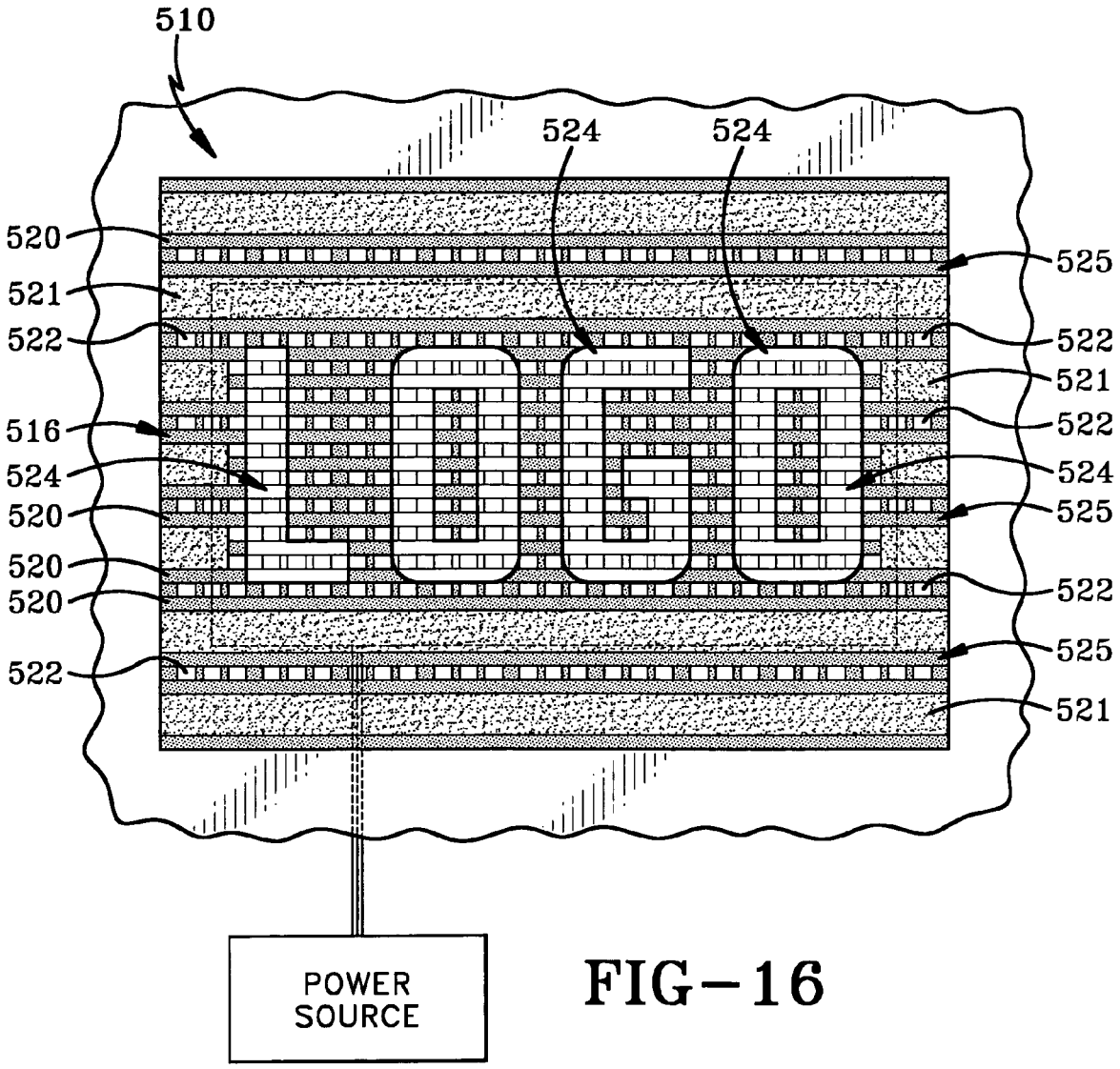
FIG. 16 is a top view of a sixth embodiment of a floor mat system in accordance with the present invention.

FIG. 16 illustrates a sixth embodiment of a floor mat system in accordance with the present invention and generally indicated at 510. Mat 510 is of a type that preferably has both scraping and wiping characteristics to remove particulate material from the shoes of people walking over the same. Mat 510 is constructed with solid vinyl areas 520 which are punctuated by strips 521 of fibrous material such as carpet. Fibrous strips 521 may be of a type that captures dirt therein or alternatively may serve to simply scrape and wipe particulate material from shoes. Solid areas 520 also preferably include a plurality of apertures 522 which allow the particulate material that has been scraped off shoes by the fibrous strips 521 to be removed from the upper surface 516 of the mat 510. Mat 510 may be a flow-through type mat where apertures 522 allow particulate material to drop onto a floor surface on which mat 510 rests. Alternatively, mat 510 may have a substantially solid bottom wall (not shown) and apertures 522 allow particulate material to drop through onto the bottom wall. Mat 510 may also include a plurality of wells (not shown) formed in solid areas 520 and which are entered through apertures 522 and particulate matter may accumulate in these wells.

Mat 510 is configured so that the non-transparent area 525 of the mat surrounding and including the LOGO 524 is free of any fibrous strips 521 and includes only the solid areas 520 and apertures 522. The exact configuration and positioning of solid areas 520, fibrous strips 521 and apertures 22 can vary widely with the intended application of the mat. It will therefore be understood by those skilled in the art that fibrous strips 521 may be of any shape and arranged in any pattern with respect to solid areas 520 without departing from the spirit of the present invention. Fibrous strips 521 reduce the amount of particulate material that would be carried across mat 520 on customers shoes and that might accumulate on the LOGO and thereby reduce the light shining outwardly therethrough from the light source (not shown).

Figure 17:
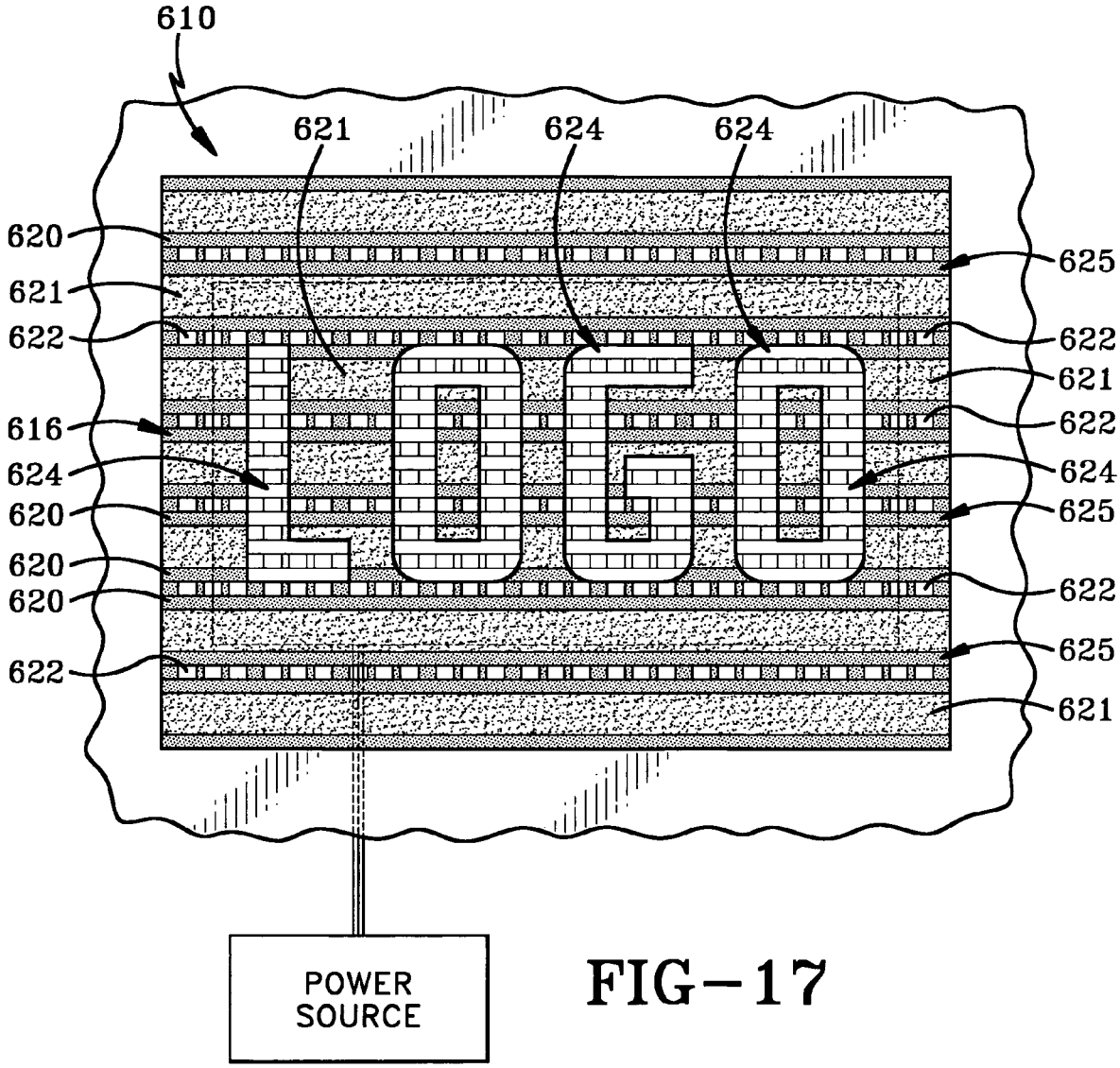
FIG. 17 is a top view of a seventh embodiment of a floor mat system in accordance with the present invention.
Figure 18:
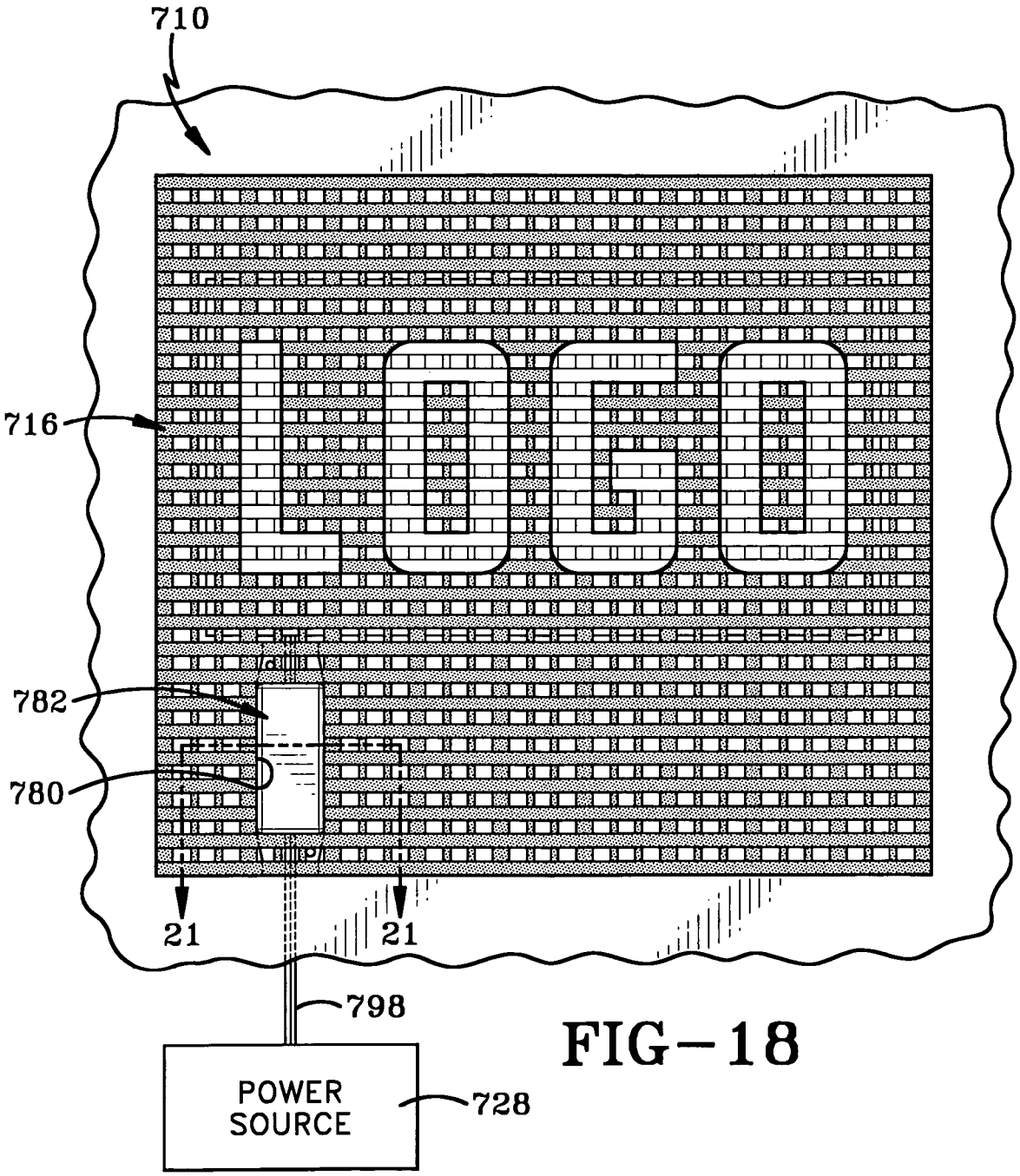
FIG. 18 is a top view of a floor mat system that includes a transformer.
Figure 19:
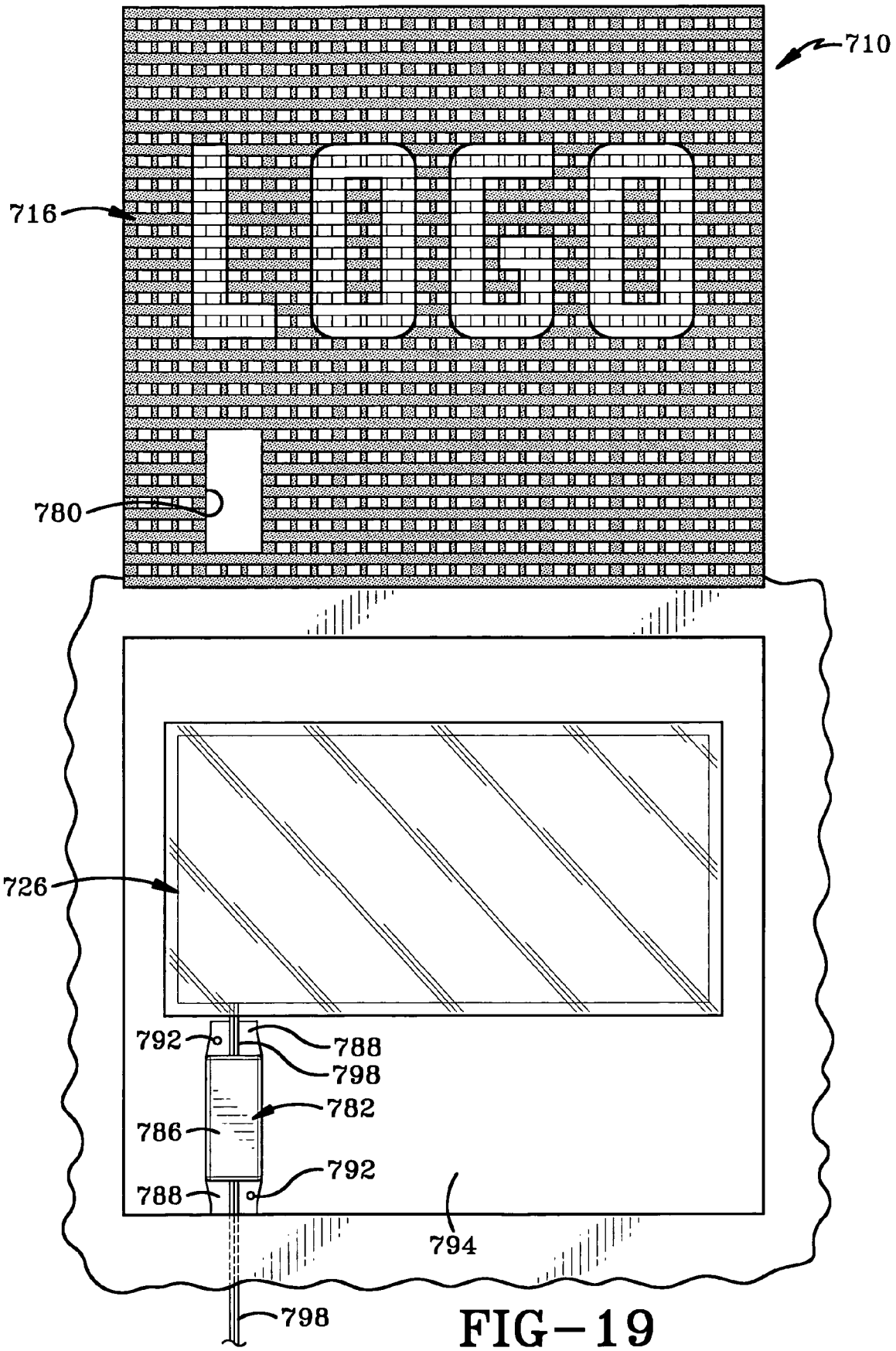
FIG. 19 is an exploded top view of the floor mat system of FIG. 18.
Figure 20:
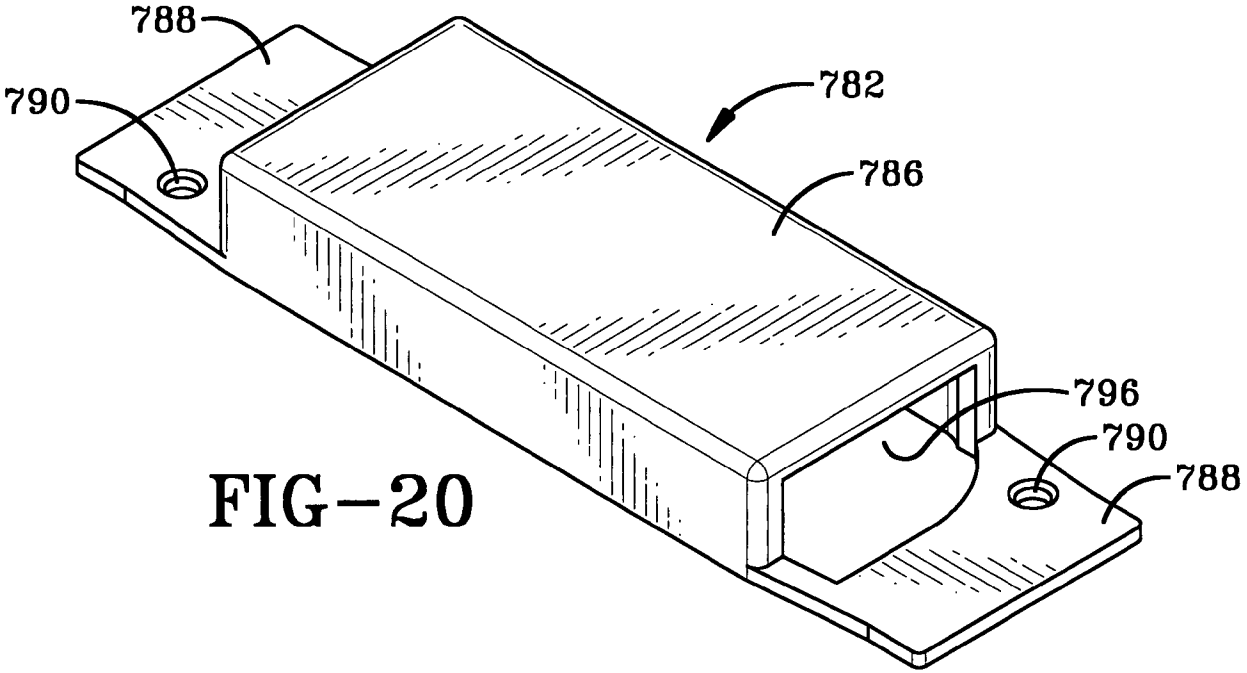
FIG. 20 is a perspective view of the transformer box.

FIG. 17 illustrates a seventh embodiment of a floor mat system in accordance with the present invention and is generally indicated at 610. Mat 610 is substantially identical to mat 510, having fibrous strips 621 alternating with solid areas 620 that include a plurality of apertures 622. Mat 610 differs from mat 510 in that fibrous strips 621 run substantially continuously across the entire width of mat 610 and are only cut away to form the individual letters of the LOGO 624.

Figure 21:
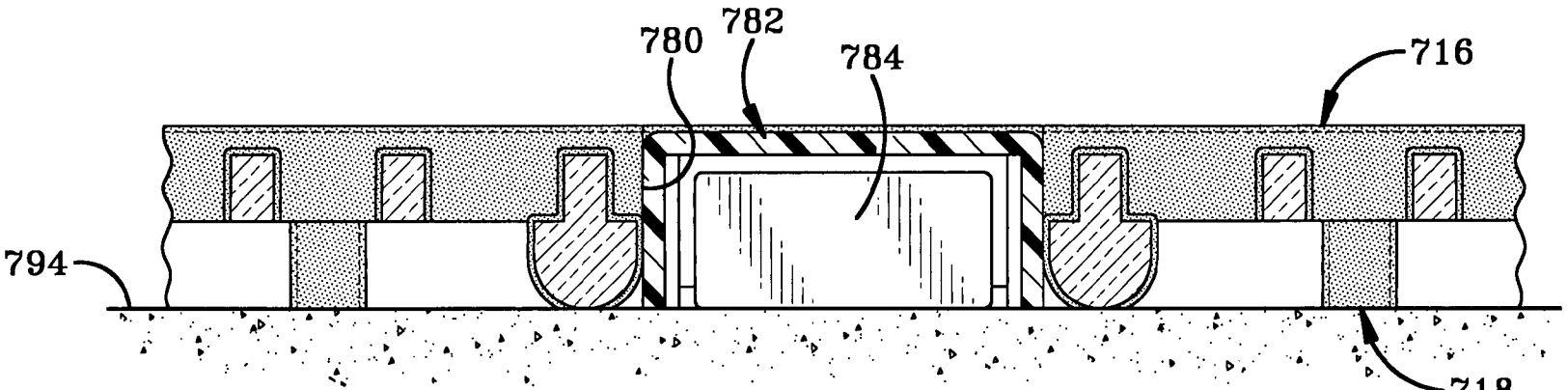
FIG. 21 is a cross-sectional view through line 21-21 of FIG. 18.

FIGS. 18-21, show that mat 710 may be provided with an opening 780 that is cut through from upper surface 716 through lower surface 718 (FIG. 21). Opening 780 is sized to receive a transformer housing 782 which in turn receives and protects a transformer 784 from being damaged as people walk across mat 710. Housing 782 includes a box 786 that is sized to receive transformer 784 and a pair of opposing wings 788 that extend outwardly therefrom. Wings 788 each include at least one hole 790 which allows for the insertion of a fastener 792 for securing housing 782 to a base 794 or to a floor. Opening 780 and transformer housing 782 allow transformer 784 to be safely positioned between light source 726 and power source 728. The openings 796 in either side of housing 782 allow for electrical wires 798 to pass between transformer 784 and the light and power sources 726, 728.

Figure 22:
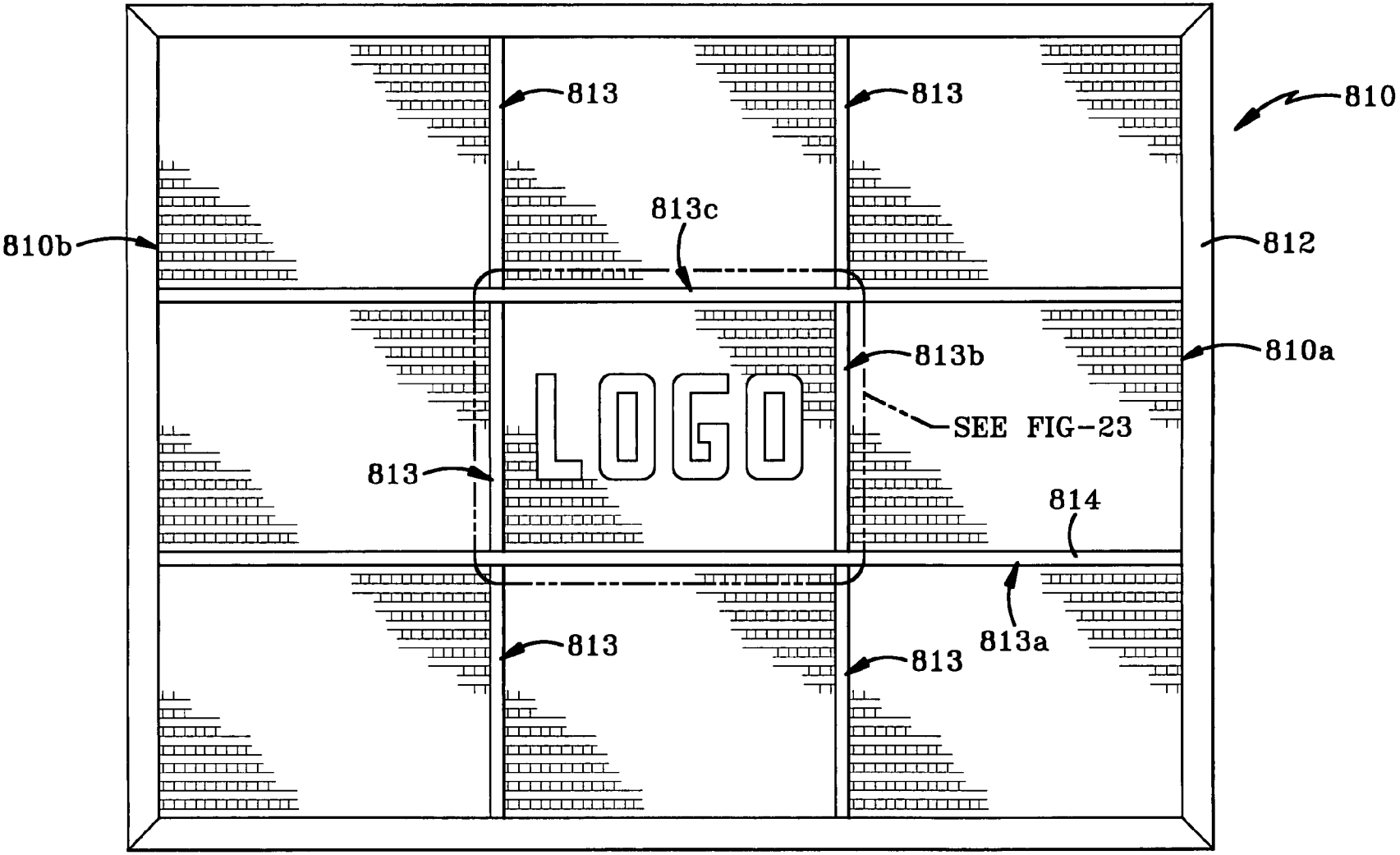
FIG. 22 is a top view of a floor mat system that incorporates a plurality of mat sections and includes channels for electrical wiring therein.
Figure 23:
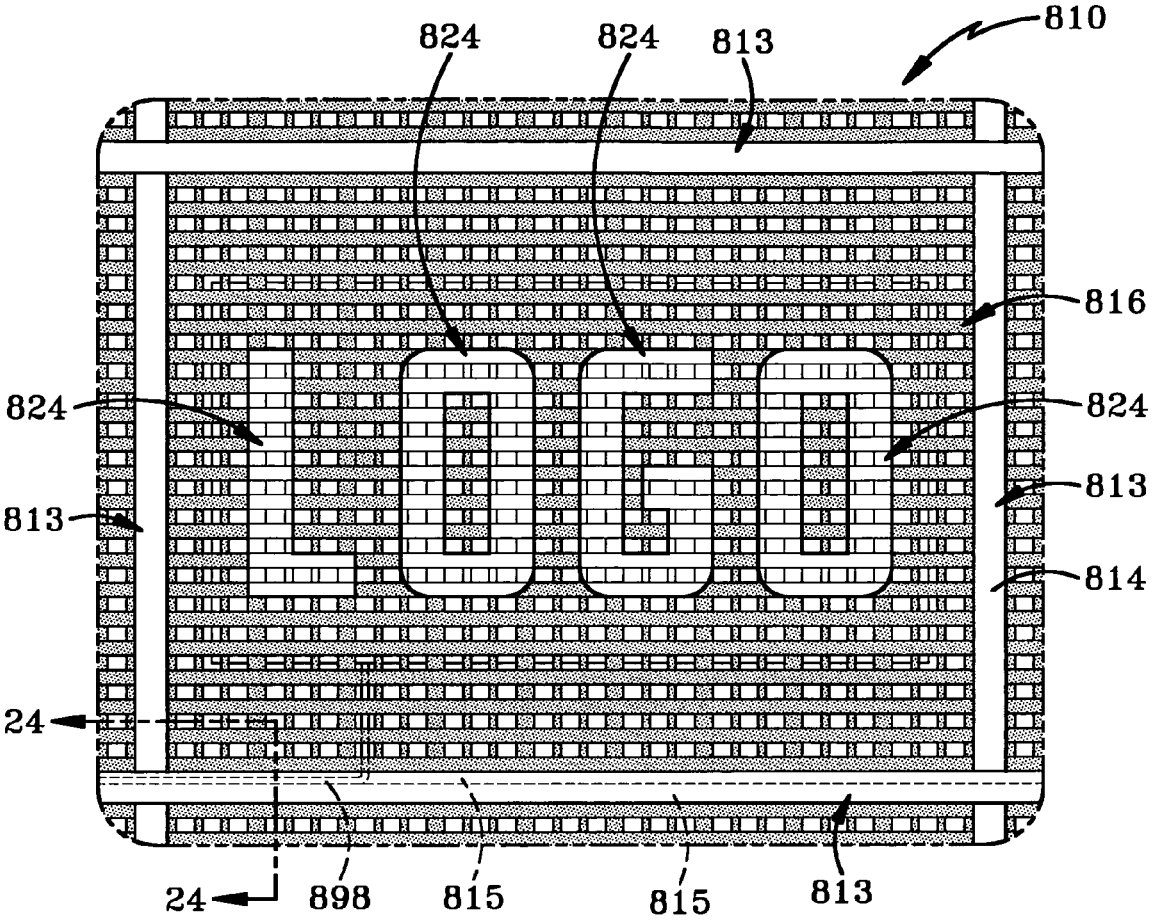
FIG. 23 is an enlarged top view of the highlighted section indicated in FIG. 22.
Figure 24:
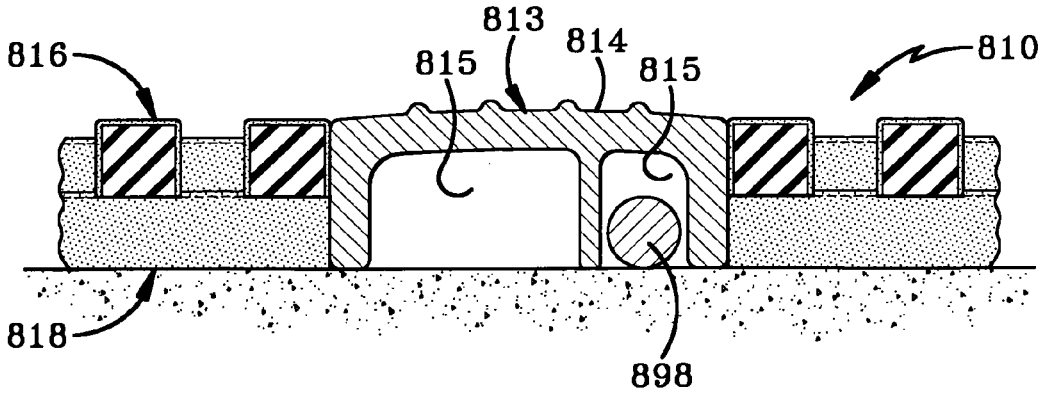
FIG. 24 is a cross-sectional view through line 24-24 of FIG. 23.

FIGS. 22-24 show a floor mat system in accordance with the present invention and generally indicated at 810. Mat 810 is of a type that is surrounded by a frame 812. Mat 810 is shown partially faded away to reveal a plurality of channels 813 disposed in mat 810 and extending from upper surface 816 through to lower surface 818. Channels 813 include a top surface 814 that may be textured so as to form a part of the different elevations in upper surface 816 of mat 810. Top surface 814 is formed as a non-slip, gripping surface. Channels 813 also include one or more longitudinal chambers 815 through which some of the electrical wiring 898 can safely pass. Channels 813 protect wiring 898 from being damaged as people walk over mat 810 and also clearly indicate where the wires are in the mat so that if the mat is being screwed into a base or into the floor, the workmen will know exactly where not to screw a fastener. FIG. 24 shows that chambers 815 of channels 813 are open at the lower surface side of mat 810. This allows electrical wires 898 to be threaded into and through channels 813 and to follow the pathway that is desired by an electrician. Channels 813 allow wiring 898 to be transferred from one side edge 810*a* (FIG. 22) of mat 810 to another side edge 810*b* thereof. Channels 813 also provide a way to change the direction of the wiring in the mat. So, for example, wiring could be introduced into channel 813*a* (FIG. 22) then turned through 90° into channel 813*b* and then again through 90° and through channel 813*c*. Consequently, wiring 898 can be delivered to any part of the light source where it is needed to allow for easier connection of the same to the power source (not shown). It will be noted from FIG. 23, that the region of mat 810 that includes the LOGO 824, which is positioned above the light source (not shown), is surrounded by channels 813 to allow electrical wiring to be brought to from any of the side edges of mat 810 and to the light source.

It will be understood by those of ordinary skill in the art that the entire mat may be manufactured from a transparent, non-flow-through type material that includes a non-slip upper surface, without departing from the spirit of the present invention. As with the previously described insert of non-flow-through material, a paint can be applied over a logo template to create the desired transparent logo surrounded by non-transparent regions.

As will be further understood by those of ordinary skill in the art, there are numerous possible ways in which the present invention can be undertaken in already known mats and mat systems. The provision of a transparent upper region of a mat with a logo or design formed in the same and surrounded by non-transparent regions, and a light source positioned thereunder can be provided in an insert type mat system, a stand-alone mat system, flow-through type mats, non-flow-through welled mats, textured surface mats or and all other combinations of the same without departing from the spirit of the present invention. The logo or design may be formed in the mat in any of variety of ways without departing from the spirit of the invention. So, for example, the design may be physically cut into a non-transparent first layer and then that cut out layer may be completely covered by a transparent upper layer so that the light shines through the cut out and highlights the design.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A floor mat system comprising:

a mat having an upper surface, a lower surface and an interior region thereinbetween;

a decorative image formed in the upper surface of the mat, said decorative image being formed partially by a first portion of the upper surface which allows light to pass through it and partially by a second portion of the upper surface which substantially prevents light from passing through it, a light source disposed within the interior region beneath at least some of both of the first and second portions the upper surface, whereby light emitted from the light source causes the decorative image to be visibly displayed, and a plurality of apertures provided in the upper surface, said apertures being adapted to allow particulate and liquid matter to move downwardly away from the upper surface of the mat and toward the lower surface of the mat.

2. The floor mat system as defined in claim 1, wherein the light source is a substantially planar light pad.

3. The floor mat system as defined in claim 1, wherein the mat has an upper wall and a lower wall and the light source is disposed therebetween, and wherein the light source is enveloped in a protective coating such that a first portion of the coating is disposed between the light source and the upper wall and a second portion of the coating is disposed between the light source and the lower wall.

4. The floor mat system as defined in claim 3, wherein the protective coating is a polycarbonate resin film applied to an upper side and a lower side of said light source.

5. The floor mat system as defined in claim 1, wherein a plurality of regions of the light source are crimped and are unable to emit light rays therefrom.

6. The floor mat system as defined in claim 1, wherein the light source is configured in the same shape as the decorative image.

7. The floor mat system as defined in claim 1, wherein the second portion of the floor mat has a non-transparent coating applied thereto, whereby light cannot travel through said second portion; and wherein the first portion of the floor mat is free of the non-transparent coating.

8. The floor mat system as defined in claim 1, wherein the apertures extend from the upper surface through the lower surface of the mat, whereby the mat is adapted to allow particulate and liquid matter to be moved from the upper surface of the mat through to beneath the lower surface thereof.

9. The floor mat system as defined in claim 1, wherein the apertures extend inwardly into the mat from the upper surface and terminate a distance above the lower surface thereof to form welled areas, whereby the mat is adapted to allow particulate and liquid matter to be moved from the upper surface of the mat and into the welled areas.

10. The floor mat system as defined in claim 1, further comprising a base into which the mat is inserted; and wherein the base and mat form a stand-alone mat that is adapted to be placed on the top of a flat floor surface.

11. The floor mat system as defined in claim 10, wherein the base includes a ramped peripheral wall surrounding a substantially continuous recessed floor; and wherein the mat is inserted over said recessed floor and is substantially flush with a top portion of the ramped wall.

12. The floor mat system as defined in claim 11, further comprising a light source positioned beneath the at least first portion of the mat and above the floor of the base; whereby the decorative image is illuminate from underneath when the light source is activated.

13. The floor mat system as defined in claim 11, wherein the apertures permit particulate and liquid matter to flow from the upper surface of the mat, through the lower surface of the mat and onto the floor of the base.

14. The floor mat system as defined in claim 1, wherein the mat includes an upper surface that has multiple elevations and is a gripping, non-slip surface.

15. The floor mat system as defined in claim 1, wherein the mat has a lower wall adapted to abut a floor and an upper wall spaced a distance away from the lower wall, and the upper wall includes an upper surface; and wherein the mat further comprises a plurality of fibrous regions which extend upwardly from the upper surface of the upper wall and, said fibrous regions include fibrous material that is adapted to scrape and wipe particulate and liquid matter from the shoes of persons walking over the mat.

16. The floor mat system as defined in claim 15, wherein the fibrous regions are located only in the second portion of the mat.

17. The floor mat system as defined in claim 16, wherein the fibrous regions are interspersed throughout the first and second regions of the mat and only the decorative image is free of fibrous regions.

18. The floor mat system as defined in claim 1, wherein the mat has a first region that is flow-through and a second region that is non-flow-through; and the decorative image is formed in the non-flow-through second region of the mat.

19. The floor mat system as defined in claim 18, wherein the second region of the mat includes a non-slip gripping surface.

20. The floor mat system as defined in claim 1, further including:

an opening formed in the upper surface of the mat; and a transformer housing complementary sized and shaped to be received within the opening; said transformer housing being adapted to receive a transformer therein.

21. The floor mat system as defined in claim 20, wherein the transformer housing includes a box portion and a pair of wings that extend outwardly away from the box portion; said wings being adapted to receive fasteners therethrough to secure the transformer housing to a solid surface.

22. The floor mat system as defined in claim 1, wherein the mat has at least a first and a second side edge; and the mat system further comprises at least a first channel that extends from the first side edge through the second side edge; said first channel having at least one chamber formed therein that is adapted to receive electrical wiring therethrough.

23. The floor mat system as defined in claim 22, further comprising at least a second channel, said second channel including at least one chamber that is operationally connected to chamber of the first channel; and wherein said first and second channels form a pathway through the mat that is adapted to receive electrical wiring therein.

24. The floor mat system as defined in claim 23, wherein the first and second channels extend from the upper surface of the mat through to the lower surface of the mat.

25. The floor mat system as defined in claim 24, wherein the first and second channels are substantially open for access from the lower surface of the mat.

26. The floor mat system as defined in claim 25, wherein a top surface of the first and second channels is formed to constitute a non-slip gripping surface of the mat.

27. The floor mat as defined in claim 1, wherein the plurality of apertures are provided in at least part of one or both of the first portion and second portion.

28. A floor mat for high traffic areas, said floor mat comprising:

a flow-through mat having an upper surface including a first area that allows light to pass therethrough and a second area that prevents light from passing therethrough, a decorative image formed partially in the first area and partially in the second area of the upper surface, a light source provided beneath the upper surface, said light source being activated to direct light rays through the decorative image;

a protective film applied directly to an upper and a lower surface of the light source such that a first portion of the protective film is disposed between the light source and the upper surface of the mat; and a plurality of apertures provided in the mat, said apertures being adapted to allow particulate and liquid matter to move downwardly away from the upper surface of the mat and toward the upper surface of the light source.

29. The floor mat as defined in claim 28, further comprising:

a base into which the mat is inserted, said base including a ramped peripheral wall surrounding a recessed floor;

a connector for securing the mat to the base.

30. The floor mat as defined in claim 29, wherein the connector comprises one of an adhesive and a reclosable fastener; and wherein the connector is applied between the protective film on the lower surface of the light source and the floor of the base.

31. The floor mat as defined in claim 28, wherein the plurality of apertures are provided in at least part of one or both of the first area and second area.

32. A floor mat system comprising:

a base having an upper surface and a lower surface;

a light source proximate the lower surface of the base;

a first portion of the base which allows light to pass therethrough;

a second portion of the base which substantially prevents light from passing therethrough and wherein the second portion is generally co-planer with the first portion;

a decorative image formed by complementary shaped areas of the first and second portions; whereby the light source is disposed between the decorative image and the lower surface of the base; and a plurality of apertures defined in at least a part of the first portion and at least a part of the second portion of the mat, said apertures being adapted to allow particulate and liquid matter to move downwardly away from the upper surface to the lower surface.

33. A floor mat system comprising:

a mat having an upper surface, a lower surface and an interior region thereinbetween;

a decorative image formed in the upper surface of the mat, said decorative image being formed partially by a first portion of the upper surface which allows light to pass through it and partially by a second portion of the upper surface which substantially prevents light from passing through it, and a light source disposed within the interior region beneath at least some of both of the first and second portions the upper surface, whereby light emitted from the light source causes the decorative image to be visibly displayed.

34. The floor mat system as defined in claim 33 wherein the decorative image is fixed and is not modifiable so that the same decorative image is displayed by the floor mat at all times.

* * * * *